US009560950B2

(12) United States Patent
Kawai et al.

(10) Patent No.: US 9,560,950 B2
(45) Date of Patent: Feb. 7, 2017

(54) BULKY SHEET AND METHOD FOR PRODUCING SAME

(75) Inventors: Takashi Kawai, Haga-gun (JP); Akemi Yuji, Haga-gun (JP); Yutaka Saito, Utsunomiya (JP); Manabu Kaneta, Utsunomiya (JP)

(73) Assignee: KAO CORPORATION, Tokyo (JP)

( * ) Notice: Subject to any disclaimer, the term of this patent is extended or adjusted under 35 U.S.C. 154(b) by 865 days.

(21) Appl. No.: 13/885,191

(22) PCT Filed: Nov. 22, 2011

(86) PCT No.: PCT/JP2011/076897
§ 371 (c)(1),
(2), (4) Date: May 14, 2013

(87) PCT Pub. No.: WO2012/070568
PCT Pub. Date: May 31, 2012

(65) Prior Publication Data

US 2013/0232712 A1 Sep. 12, 2013

(30) Foreign Application Priority Data

Nov. 22, 2010 (JP) ..... 2010-260639

(51) Int. Cl.
*D04H 1/495* (2012.01)
*A47L 13/16* (2006.01)
(Continued)

(52) U.S. Cl.
CPC ..... *A47L 13/16* (2013.01); *D04H 1/495* (2013.01); *D04H 1/558* (2013.01); *D04H 1/732* (2013.01); *D04H 1/76* (2013.01)

(58) Field of Classification Search
CPC ..... D04H 1/465; D04H 1/492; D04H 1/495; D04H 5/03; D04H 18/04; D04H 3/11; D04H 18/00; D04H 1/732; D04H 1/558; D04H 1/76; A47L 13/16
(Continued)

(56) References Cited

U.S. PATENT DOCUMENTS 3,681,183 A * 8/1972 Kalwaites ..... D04H 1/70 28/105
3,750,237 A * 8/1973 Kalwaites ..... D04H 1/70 28/105
(Continued)

FOREIGN PATENT DOCUMENTS

AU 647503 B2 3/1994
CN 1356423 A 7/2002
(Continued)

OTHER PUBLICATIONS

International Search Report, issued in PCT/JP2011/076897, dated Jan. 24, 2012.
(Continued)

*Primary Examiner* — Amy Vanatta
(74) *Attorney, Agent, or Firm* — Birch, Stewart, Kolasch & Birch, LLP

(57) ABSTRACT

A bulky sheet (10) has a first side (11), a second side (12) opposite to the first side (11), a plurality of macroscopic first recessed ridges (21) and a projection (30) on at least the first side (11). The first recessed ridges (21) extend straight in a first direction at a predetermined interval. The projection (30) is located between the first recessed ridges (21) adjacent to each other. The projection (30) projects from the second side (12) toward the first side (11) of the bulky sheet (10).

6 Claims, 11 Drawing Sheets

(51) Int. Cl.
*D04H 1/732* (2012.01)
*D04H 1/558* (2012.01)
*D04H 1/76* (2012.01)

(58) Field of Classification Search
USPC ..... 28/104, 105
See application file for complete search history.

(56) References Cited

U.S. PATENT DOCUMENTS

| | | | | |
|---|---|---|---|---|
| 4,718,152 | A | 1/1988 | Suzuki et al. | |
| 4,868,958 | A * | 9/1989 | Suzuki | D04H 18/04 28/104 |
| 5,137,600 | A * | 8/1992 | Barnes | D21H 25/005 162/115 |
| 5,353,485 | A * | 10/1994 | Billgren | D04H 1/44 28/104 |
| 5,525,397 | A | 6/1996 | Shizuno et al. | |
| 5,618,610 | A | 4/1997 | Tomita et al. | |
| 5,736,219 | A | 4/1998 | Suehr et al. | |
| 6,338,187 | B1 * | 1/2002 | Fleissner | B26F 1/26 26/3 |
| 6,395,957 | B1 | 5/2002 | Chen et al. | |
| 6,513,184 | B1 | 2/2003 | Brown et al. | |
| 6,692,541 | B2 * | 2/2004 | Carlson | D04H 3/02 28/104 |
| 6,695,941 | B2 * | 2/2004 | Hartgrove | B24D 11/001 156/148 |
| 6,764,971 | B2 * | 7/2004 | Kelly | D04H 1/495 28/104 |
| 7,310,859 | B2 * | 12/2007 | Fleissner | D04H 18/04 28/104 |
| 2001/0029966 | A1 | 10/2001 | Wong et al. | |
| 2002/0100153 | A1 | 8/2002 | Takai et al. | |
| 2003/0008108 | A1 | 1/2003 | Shizuno et al. | |
| 2003/0009862 | A1 * | 1/2003 | Black | B32B 5/26 28/104 |
| 2003/0045197 | A1 | 3/2003 | Kakiuchi et al. | |
| 2003/0176132 | A1 | 9/2003 | Moriyasu et al. | |
| 2003/0213108 | A1 * | 11/2003 | Strandqvist | D21F 1/0063 28/104 |
| 2005/0155200 | A1 * | 7/2005 | Fleissner | D04H 1/492 28/104 |
| 2005/0255297 | A1 | 11/2005 | Otsuka et al. | |
| 2007/0128411 | A1 | 6/2007 | Kawai et al. | |
| 2008/0010795 | A1 | 1/2008 | Mizutani et al. | |
| 2008/0160859 | A1 | 7/2008 | Gupta et al. | |
| 2013/0158497 | A1 | 6/2013 | Yamaguchi et al. | |

FOREIGN PATENT DOCUMENTS

| | | | |
|---|---|---|---|
| CN | 1436886 | A | 8/2003 |
| CN | 1834325 | A | 9/2006 |
| CN | 101573481 | A | 11/2009 |
| EP | 0 223 614 | A2 | 5/1987 |
| GB | 2114173 | A | 8/1983 |
| JP | 58-132155 | A | 8/1983 |
| JP | 8-302555 | A | 11/1996 |
| JP | 2001-198066 | A | 7/2001 |
| JP | 2001-521590 | A | 11/2001 |
| JP | 2002-369782 | A | 12/2002 |
| JP | 2004-500943 | A | 1/2004 |
| JP | 2005-256273 | A | 9/2005 |
| JP | 2006-320728 | A | 11/2006 |
| JP | 2007-154359 | A | 6/2007 |
| JP | 2012-52253 | A | 3/2012 |
| RU | 2 176 143 | C2 | 11/2001 |
| RU | 2 393 279 | C1 | 6/2010 |
| WO | WO 98/52458 | A1 | 11/1998 |
| WO | WO 01/88261 | A1 | 11/2001 |
| WO | WO 02/086217 | A1 | 10/2002 |
| WO | WO 03/087457 | A1 | 10/2003 |
| WO | WO 2004/022830 | A1 | 3/2004 |
| WO | WO 2007/114742 | A1 | 10/2007 |

OTHER PUBLICATIONS

International Preliminary Report on Patentability, and Translation of Written Opinion of the International Searching Authority, dated Jun. 20, 2013, for International Application No. PCT/JP2011/076897 (Forms PCT/IB/338, PCT/IB/373 and PCT/ISA/237).

Singapore Search Report, dated Jun. 12, 2014, for Singapore Application No. 201303677-7.

* cited by examiner

BULKY SHEET AND METHOD FOR PRODUCING SAME

TECHNICAL FIELD

The present invention relates to a bulky sheet and a method for producing the same, particularly a bulky sheet suited for use as a cleaning sheet and a method for producing the same.

BACKGROUND ART

The assignee common to this application previously proposed a bulky sheet including a fiber aggregate formed by hydroentangling a fiber web and having a plurality of projections and depressions (see patent literature 1 below). The bulky sheet is produced by subjecting a fiber aggregate obtained by hydroentangling a fiber web to a second hydroentanglement treatment on a patterning member having a plurality of projections and depressions and a plurality of perforations. The bulky sheet obtained by this method has a plurality of projections that provide flexibility and good hand and is therefore suited for use as a cleaning sheet. Moreover, the method produces a bulky sheet at a low cost. When used as a cleaning sheet, the bulky sheet is capable of trapping and holding fine dust adhering to the surface being cleaned between constituent fibers.

Apart from the above technique, patent literature 2 below discloses a nonwoven fabric wiper composed of a fibrous material and having a plurality of undulations on at least one side thereof. According to the literature, the wiper is produced through the following steps (a) to (c):

(a) forming a stack composed of at least one hydrophilic fiber web and at least one thermally self-crimping hydrophobic fiber web,
(b) directing high pressure jets of water from fine orifices to the stack placed on a support screen having a continuous flat portion and a plurality of discretely distributed projections and/or recesses and a plurality of fine drain apertures thereby to entangle and re-arrange the fibers of the two kinds of webs to provide a nonwoven fabric having fiber density unevenness in its planar direction, and
(c) dewatering and/or drying the nonwoven fabric, followed by heat treatment to crimp the synthetic fibers.

A wiper having a plurality of undulations with a relatively large surface level difference is obtained by the method of patent literature 2. However, the need to use two kinds of fibers—hydrophilic fibers and thermally self-crimping hydrophobic fibers, and to conduct heat treatment to cause the thermally self-crimping hydrophobic fibers to self-crimp makes the processing steps complicated, which is economically disadvantageous.

Patent literature 3 discloses a nonwoven fabric having at least one of predetermined groove portions, openings, and protrusions that is obtained by directing a fluid mainly comprising gas onto a side of a fiber aggregate having a sheet form placed on a prescribed air-permeating support. The fiber aggregate contains thermoplastic fibers that soften at a prescribed temperature. The production of this nonwoven fabric involves softening the thermoplastic fibers by heating. This makes the processing steps complicated and is economically disadvantageous.

Patent literature 4 discloses a non-apertured cleaning sheet the working face of which comprises nonrandom raised regions and recessed regions. The recessed regions form a continuous pattern in the X-Y dimension surrounding discrete raised regions, and the continuous pattern consists of channels. The working face has an average height differential of at least about 1 mm and a total pore volume of greater than 750 gsm. The method for making the cleaning sheet involves the step of hydroentangling the fibers of a nonwoven structure on a forming belt having a desired pattern of raised and recessed regions. This makes the processing steps complicated and is economically disadvantageous. Furthermore, the recessed regions of the cleaning sheet have disadvantageously low capability of trapping large particles.

CITATION LIST

Patent Literature

Patent literature 1: US 2003/0008108A1
Patent literature 2: U.S. Pat. No. 5,618,610A
Patent literature 3: US 2008/0010795A1
Patent literature 4: US 2001/0029966A1

SUMMARY OF INVENTION

The present invention provides a method for making a bulky sheet. The method includes directing high pressure water jets to a fiber web to entangle the fibers with themselves to form an entangled fiber web, placing the entangled fiber web on a first patterning member having apertures in a prescribed pattern, and subjecting the entangled fiber web placed on the first patterning member to high pressure water jets to cause part of the entangled fiber web to project into the apertures of the first patterning member. The first patterning member includes a plurality of first wire-like members extending in one direction and arranged at a predetermined spacing and a support having a plurality of openings. The support underlies the plurality of first wire-like members.

The invention also provides a bulky sheet formed by entangling fibers of a fiber web with themselves and having a first side and a second side opposite to the first side. The bulky sheet has a plurality of macroscopic first recessed ridges and a plurality of projections on at least the first side. The plurality of first recessed ridges extend straight in a first direction at an interval of 0.825 to 15 mm, the first direction being coincident with the orientation direction of the fibers. The projection is located between the first recessed ridges adjacent to each other. The projection projects from the second side toward the first side of the bulky sheet.

The invention also provides a bulky sheet formed by entangling fibers of a fiber web with themselves and with a scrim and having a first side and a second side opposite to the first side. The bulky sheet has a plurality of macroscopic first recessed ridges and a plurality of macroscopic projections on at least the first side. The plurality of first recessed ridges extend straight in a first direction at an interval of 0.825 to 15 mm, the first direction being coincident with the orientation direction of the fibers. The projection is located between the first recessed ridges adjacent to each other. The projection projects from the second side toward the first side of the bulky sheet. The bulky sheet has a first region and a second region in a plan view. The first region has a higher fiber density and a smaller thickness than the second region. The second region has a lower fiber density and a larger thickness than the first region. The second region is delineated by the first region. The first region has a first portion extending in the orientation direction of the fibers and a second portion extending in the direction perpendicular to the direction in which the first portion extends. The second portion measures 286 mm or more in direct distance in the orientation direction of the fibers when the distance between second portions adjacent to each other is longer than that between first portions adjacent to each other. The second portion measures 206 mm or more in the direction perpendicular to the direction in which the first portion extends when the distance between first portions adjacent to each other is longer than that between second portions adjacent to each other.

ADVANTAGEOUS EFFECTS OF INVENTION

The bulky sheet of the invention has flexibility and good hand. When used as a cleaning sheet, in particular, the bulky sheet of the invention is capable of effectively trapping relatively large dust particles, like bread crumbs, present on the places difficult to be cleaned, such as the spaces between floor panels and the recesses on the surface of furniture and appliances. The production method of the invention produces such a bulky sheet easily.

BRIEF DESCRIPTION OF DRAWINGS

FIG. 2(*b*) is a cross-section taken along line b-b of FIG. 2(*a*).

FIG. 3(*b*) is a cross-section taken along line b-b of FIG. 3(*a*).

FIG. 5(*b*) is a perspective of a part of the drum-shaped patterning member shown in FIG. 5(*a*) in an opened and flattened state.

DESCRIPTION OF EMBODIMENTS

The invention provides a bulky sheet that exhibits excellent dust trapping capabilities when used as a cleaning sheet and a method for making the same.

The invention will be described based on its preferred embodiments with reference to the accompanying drawings. The bulky sheet of the invention includes a sheet formed of a fibrous material and has a first side and a second side opposite to the first side. Both the first and second sides are formed of the fibrous material. The bulky sheet of the invention may be composed solely of the fibrous material or may contain other material in addition to the fibrous material. The other material is exemplified by a scrim as will be described later.

The bulky sheet of the invention is obtained by entangling fibers of a fiber web. In the case when the bulky sheet contains a scrim in addition to the fiber web, the fibers making up the fiber web are entangled with not only themselves but also the scrim. As used herein, the term "fiber web" denotes a fiber aggregate having no shape retention. The fiber web is made into a highly shape-retentive fiber sheet by highly entangling its constituent fibers. The process for entangling the fibers is not particularly limited, and any process known in the art may be used. For example, needle punching would be effective. A particular preferred process of entanglement is hydroentanglement, which is achieved by directing high pressure water jets as hereinafter described. To achieve high dust trapping capabilities for use as a cleaning sheet, it is preferred that the bulky sheet owe its shape retention only to the fiber entanglement. Part of the fibers may contribute to the shape retention of the bulky sheet through a means other than the fiber entanglement. For example, the shape retention may be achieved by bonding the fibers at their intersections by, for example, fusion bonding or adhesion with an adhesive.

Figure 1:
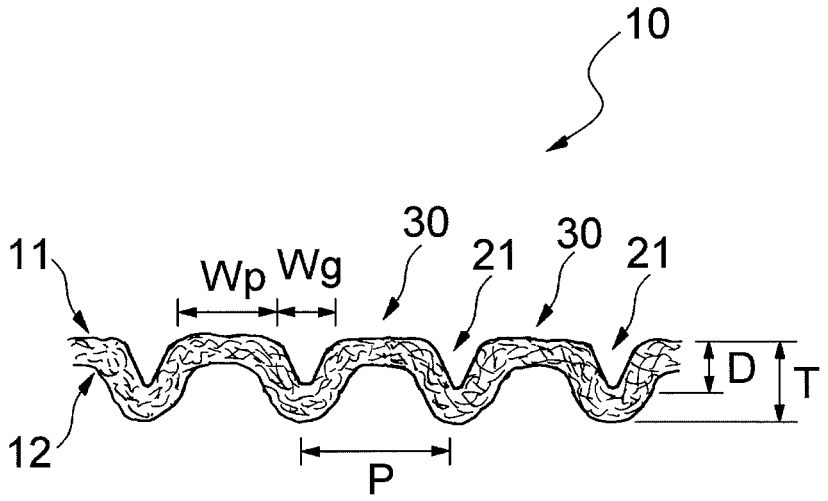
FIG. 1 is a vertical cross-section of a bulky sheet according to an embodiment of the invention.

FIG. 1 is a vertical cross-section of a bulky sheet according to an embodiment of the invention. As previously stated, the bulky sheet 10 has a first side 11 and a second side 12 opposite to the first side 11. The bulky sheet 10 has a plurality of macroscopic first recessed ridges 21 and projections 30 on at least the first side 11. As used herein, the term "macroscopic" means that, when the bulky sheet 10 shown in FIG. 1 is observed with the naked eye, the presence of the first recessed ridges 21 and the projections 30 are recognizable. So, the term does not include small grooves or projections that are unrecognizable unless a thickness cross-section of the bulky sheet 10 is observed under a microscope. More specifically, the term does not include those grooves and projections with a depth or height as small as about 0.1 mm that would be observable only under, for example, a digital microscope VHX-500 from Keyence at 20× with no load applied.

The plurality of first recessed ridges 21 extend in a first direction (the direction perpendicular to the plane of the drawing of FIG. 1) and are arranged with a prescribed space in between. The first direction is usually coincident with the machine direction (MD) of the bulky sheet 10 being manufactured. The first recessed ridge 21 substantially continuously extends straight. Adjacent first recessed ridges 21 are parallel to each other so that there are no intersections between the first recessed ridges 21. The first recessed ridge 21 has a substantially uniform depth in its extending direction. The first recessed ridges 21 are a result of the formation of the projections 30 of the bulky sheet 10 projecting from the second side 12 toward the first side 11.

The projection 30 is located between adjacent first recessed ridges 21. The projection 30 of the bulky sheet 10 projects from the second side 12 toward the first side 11. The shape of the projection 30 depends on whether or not a second recessed ridge (hereinafter described) is formed on the first side 11. Specifically, (i) when there is not a second recessed ridge formed on the first side 11, the projection 30 is a raised ridge extending in the same direction as the direction in which the first recessed ridge 21 extends, and, (ii) when there is a second recessed ridge formed on the first side 11, the projection 30 has in a plan view a nearly rectangular shape defined by the intersection of the first and the second recessed ridges. In the case (ii), a plurality of projections 30 align in a straight line in the extending direction of the first recessed ridges 21 and/or the second recessed ridge. In other words, a plurality of projections 30 align discontinuously in a straight line between adjacent first recessed ridges 21 and/or adjacent second recessed ridges to seemingly form a single raised ridge.

Since the bulky sheet 10 owes its shape retention to the fiber entanglement, the fibers constituting the bulky sheet 10 have a high degree of freedom. Therefore, the bulky sheet 10 exhibits flexibility and good hand. To have a high degree of fibers' freedom (mobility) provides the following advantages: when the bulky sheet is used as a dry cleaning sheet with its first side 11 serving as a working face, it is able to successfully catch up and trap particulate and/or fibrous dust between highly mobile fibers. Dust trapping between the highly mobile fibers is suitable for relatively small dust and is predominantly performed by the projection 30. On the other hand, relatively large dust particles, such as bread crumbs, fit in the first recessed ridge 21 and are successfully trapped therein. Since the first recessed ridge 21 extends straight, it exhibits higher trapping capabilities for relatively large dust particles than a discontinuous or snaking recessed ridge. Thus, the bulky sheet 10 of the present embodiment, when used as a cleaning sheet, is able to trap relatively small dust in its projections 30 and relatively large dust in its first recessed ridges 21. Therefore, when used as a cleaning sheet, the bulky sheet 10 of the present embodiment is capable of trapping relatively large dust particles present on the places difficult to be cleaned, such as the spaces between floor panels and the recesses on the surface of furniture and appliances, as well as relatively small dust particles.

In order to catch up and trap relatively small dust particles, it is advantageous that the fibers of the bulky sheet 10 have a high degree of freedom. However, too high a degree of fiber freedom tends to result in reduction of shape retention of the bulky sheet 10. From these considerations, it is preferable that the fiber freedom, expressed as a coefficient of entanglement (hereinafter, "entanglement coefficient"), be in the range of from 0.05 to 2 N·m/g, more preferably from 0.2 to 1.5 N·m/g. The entanglement coefficient as referred to above, which is a measure representing the degree of entanglement of constituent fibers, is represented by the initial slope of the stress-strain curve measured in the direction perpendicular to the orientation direction of the fibers in the bulky sheet 10. The smaller the coefficient, the weaker the fiber entanglement, namely the higher the degree of freedom. The "orientation direction of fibers" is a direction in which the maximum load in a tensile test is the highest, the "stress" is the quotient of a tensile load divided by the width of a specimen clamped in the tensile test and the basis weight of the bulky sheet, and the "strain" means the amount of elongation. The details for the determination of entanglement coefficient are described, e.g., in U.S. Pat. No. 6,936,333, col. 12, which is incorporated herein by reference in its entirety.

The bulky sheet 10 having an entanglement coefficient falling within the range recited can be obtained by properly selecting the conditions of hydroentanglement in the hereinafter described method for making the bulky sheet 10.

Figure 2A:
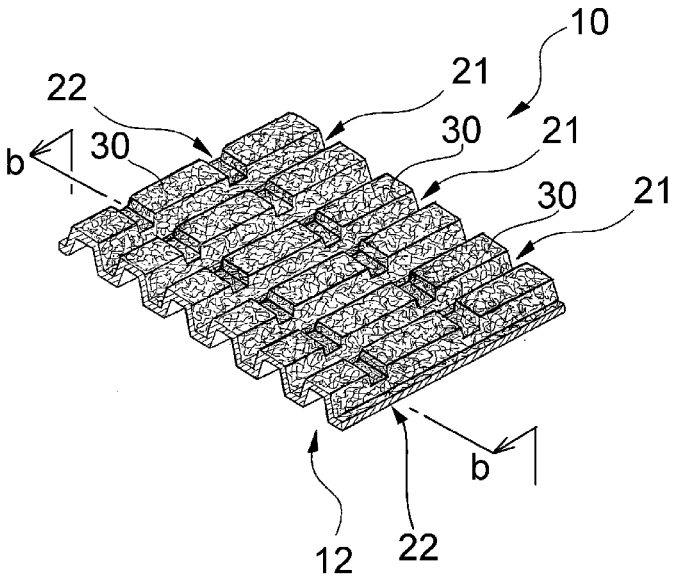
FIG. 2(*a*) is a perspective of a bulky sheet according to another embodiment of the invention.
Figure 2B:
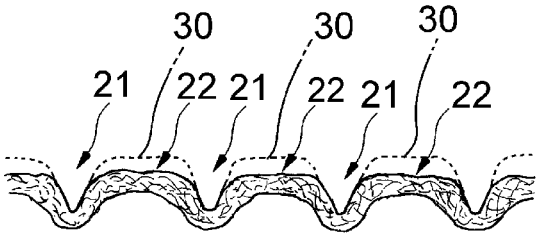
Figure 3A:
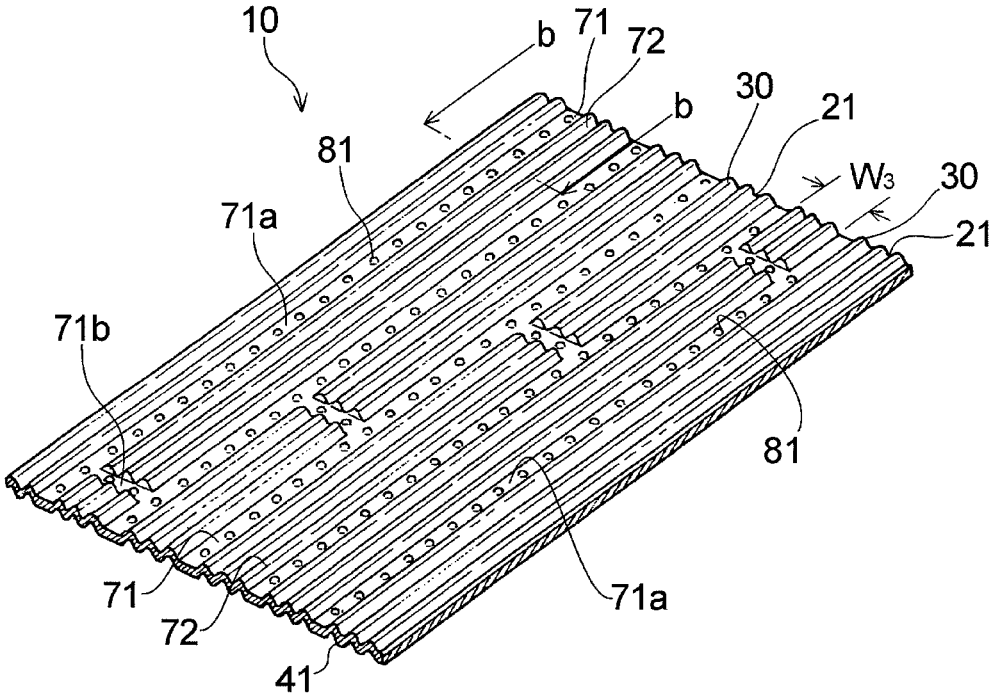
FIG. 3(*a*) is a perspective of a bulky sheet according to still another embodiment of the invention.
Figure 3B:
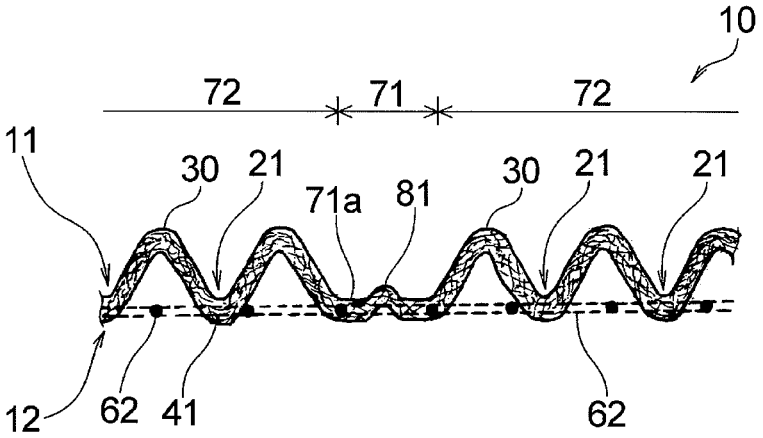

FIG. 3(*a*) shows a bulky sheet 10 different from the embodiment shown in FIG. 2. FIG. 3(*b*) is a cross-section taken along line b-b in FIG. 3(*a*). The bulky sheet 10 of FIG. 3 is different from the bulky sheet shown in FIG. 2 in that it has a first region 71 and a second region 72 in its plan view.

The bulky sheet 10 shown in FIG. 3 is a fiber sheet made mainly of a fibrous material. The bulky sheet 10 is composed of an entangled fiber web 41 formed by subjecting a fiber web to hydroentanglement and a scrim 62 disposed inside the entangled fiber web 41. The entangled fiber web 41 and the scrim 62 are united together by the entanglement of the fibers of the entangled fiber web 41 with the scrim 62.

The entangled fiber web 41 is preferably formed only by the entanglement of its constituent fibers. In that case, the bulky sheet 10 has a good feel to the touch and, when used as a cleaning sheet particularly for cleaning floors, exhibits excellent capabilities of catching and holding dust and dirt, such as hairs or fine dust, as compared with a bonded fiber web obtained by fusion bonding thermoplastic resin fibers.

The bulky sheet 10 has a first region 71 and a second region 72. The second region 72 is delineated by the first region 71. As shown in FIG. 3(*a*), the first region 71 has in a plan view a plurality of first portions 71*a* extending in the longitudinal direction and a plurality of second portions 71*b* extending in the direction perpendicular to the first portions 71*a* to interconnect the first portions 71*a* adjacent to each other. The plurality of first portions 71*a* are arranged in substantially parallel to each other at a predetermined interval. The plurality of second portions 71*b* are also arranged in substantially parallel to each other at a predetermined interval. One second portion 71*b* interconnects only two first portions 71*a* adjacent to each other and does not interconnect more than two adjacent first portions 71*a*. Each first portion 71*a* extends in substantially the same direction as the orientation direction of the fibers making up the bulky sheet 10.

The second region 72 is located in an area delineated by the first portion 71*a* and the second portion 71*b* that constitute the first region 71. It is preferred that the second region 72 not be completely surrounded by the first and the second portions 71*a* and 71*b* in the interest of improvements in dust trapping capabilities and cleaning operationality for use as a cleaning sheet. It is acceptable, though not preferred, that the first region 71 forms closed shapes in each of which a second region 72 is completely enclosed. When the distance between adjacent second portions 71*b* is longer than that between adjacent first portions 71*a* in the first region 71, the direct distance $L_1$ between adjacent second portions 71*b* in the first region 71 is preferably 286 mm or more, more preferably 286 to 400 mm, even more preferably 286 to 310 mm. When, on the other hand, the distance between adjacent first portions 71*a* is longer than that between adjacent second portions 71*b* in the first region 71, the distance $W_3$ between adjacent first portions 71*a* in the first region 71 is preferably 206 mm or more, more preferably 206 to 300 mm, even more preferably 206 to 225 mm. Formation of the first region 71 composed of the first and second portions 71*a* and 71*b* having the above described geometry provides the second region 72 with an increased area and, accordingly, the bulky sheet 10 used as a cleaning sheet will exhibit improved dust trapping capability and cleaning operationality. The inventors consider that the above-specified distance $L_1$ secures a long dust trapping portion to provide improved dust trapping capabilities, particularly for hairs as long as about 30 cm.

The first region 71 and the second region 72 are distinguished by fiber density and thickness. Specifically, the first region 71 has a higher fiber density and a smaller thickness than the second region 72. The second region 72 has a lower fiber density and a larger thickness than the first region 71. Accordingly, the bulky sheet 10 includes on its one side the second region 72 with a larger thickness and the first region 71 with a smaller thickness. Thus, the bulky sheet 10 is provided with a bulky structure by the formation of the first region 71 and the second region 72.

The second region 72 with a larger thickness has a plurality of projections 30 and a first recessed ridge 21. The projection 30 is formed by projecting the part of the entangled fiber web that constitutes the second region 72 from one side of the second region 72 toward the other side of the second region 72. The first recessed ridge 21 is between the projections 30. As a result, the second region 72 has a three-dimensionally uneven surface as a whole.

The individual projections 30 are substantially equal in size and extend in the same direction as the extending direction of the first portion 71*a* of the first region 71. The first recessed ridge 21 between adjacent projections 30 also extends in the same direction as the extending direction of the first portion 71*a* of the first region 71.

As described, the bulky sheet 10 of FIG. 3 has the second region 72 that is thick with projections and the first region 71 that is a thin and recessed region, wherein the second region 72 has the projections 30 and the first recessed ridge 21, thereby to provide a double textured structure. As a result, when used as, for example, a dry cleaning sheet, particularly for floor cleaning, the bulky sheet 10 exhibits excellent cleaning performance in removing dust and dirt from grooves between floor panels and uneven surfaces of floors and high ability to catch up and hold relatively large dust particles, such as bread crumbs. Also, the bulky sheet 10 exhibits high ability to catch up and hold dust particles, such as hairs and fine dust. Even when used as a cleaning sheet wetted with a liquid, the bulky sheet 10 shows improved cleaning operationality, particularly encounters a reduced resistance in wiping operation and exhibits improved slow-release of a cleaning liquid.

The second region 72 with a smaller fiber density being delineated by the first region 71 with a larger fiber density, the fibers of the second region 72 are effectively prevented from fuzzing or shedding while securing the increased degree of fiber freedom in the second region 72.

The first region 71 has a higher fiber density than the second region 72 as previously stated. The fiber density of the first region 71 is preferably 0.020 to 0.65 g/cm$^3$, more preferably 0.035 to 0.50 g/cm$^3$, in view of effective prevention of fibers' fuzzing or shedding in the second region 72 having a high degree of fiber freedom. On the other hand, the fiber density of the second region 72 is preferably 0.005 to 0.65 g/cm$^3$, more preferably 0.01 to 0.40 g/cm$^3$, provided that it is lower than the fiber density of the first region 71, in view of improvement on dust trapping performance when the bulky sheet 10 is used as a cleaning sheet.

The fiber density of the first and the second regions 71 and 72 is determined by the method below. Ten specimens of prescribed size are cut out of each of the first region 71 and the second region 72 of the bulky sheet 10. The thickness of each specimen is measured with a laser thickness meter with a load of 40 Pa applied to the specimen. The mass of each specimen is also measured. The measured mass is divided by the area to obtain a basis weight. The fiber density is calculated from the measured thickness and the calculated basis weight. The average of the calculated fiber densities is defined to be the "fiber density" as referred to in the invention.

The second region 72 is thicker than the first region 71. Therefore, when the bulky sheet 10 is used as, for example, a cleaning sheet, it comes into contact with the surface being cleaned mostly on its second region 72, while the first region 71 is difficult to bring into contact with the surface being cleaned. Nevertheless, the first region 71 is not entirely non-contributory to cleaning because it is formed only by the entanglement of the fibers and therefore exhibits dust trapping capabilities, though having a higher fiber density. In contrast, a recessed region formed by, for example, heat embossing has no dust trapping properties because the fibers of the recessed region are fusion bonded to each other.

When the bulky sheet 10 is used as, for example, a wet type cleaning sheet impregnated with a liquid, the wiping resistance encountered by the cleaning sheet is small. From this viewpoint, the thickness of the second region 72 is preferably 1.0 to 5.0 mm, more preferably 1.2 to 4.0 mm, and that of the first region 71 is preferably 0.1 to 1.5 mm.

The thickness of the first region 71 and the second region 72 is determined as follows. Ten specimens of prescribed size are cut out of each of the first region 71 and the second region 72 of the bulky sheet 10. The thickness of each specimen is measured with a laser thickness meter with a load of 40 Pa applied to the specimen. The average of the measured thicknesses is defined to be the "thickness" as referred to in the invention.

When the bulky sheet 10 is used as, for example, as a dry type cleaning sheet, the area ratio of the first regions 71 to the second regions 72 in a plan view is influential on the dust trapping capabilities. If the area of the first regions 71 is excessively larger than the area of the second regions 72, the area of the second regions 72 having a high degree of fiber freedom is insufficient, tending to result in reduction of the dust trapping capabilities. Accordingly, the area ratio of the first regions 71 is preferably 2% to 90%, more preferably 5% to 40%, and that of the second regions 72 is preferably 10% to 98%, more preferably 60% to 95%.

As earlier stated, the second region 72 has projections 30 and the first recessed ridge 21. It is preferred that the projections 30 and the first recessed ridge 21 be formed by re-arrangement and re-entanglement of fibers as a result of hydroentanglement carried out to the entangled fiber web 41, whereby the projections 30 and the first recessed ridge 21 retain their shape by themselves. Therefore, the projections 30 and the first recessed ridge 21 hardly lose the resilience against a load. Because of the formation of the projections 30 and the first recessed ridge 21, the apparent thickness of the bulky sheet 10 is larger than the thickness of the entangled fiber web 41 before the projections 30 and the first recessed ridge 21 are formed.

As used herein, the phrase "formed by re-arrangement and re-entanglement of fibers" means that the entangled fiber web in which the fibers are weakly interlaced with each other by hydroentanglement is again subjected to hydroentanglement on a three-dimensional patterning member to have the fibers re-arranged and re-entangled along the uneven surface profile of the patterning member.

The projections 30 and the first recessed ridge 21 are formed by zig-zag folding the entangled fiber web 41 in the thickness direction. A plurality of folds of the zig-zag folded entangled fiber web 41 correspond to the projections 30 and the first recessed ridge 21. While the projections 30 and the first recessed ridge 21 are formed as a result of re-arrangement of the fibers as described, distribution of fibers due to the fibers' flowing toward the first recessed ridge 21 under the pressure of the high pressure water jets is minimized to an extremely low degree. If fiber distribution further proceeds, a hole will be formed in the site where a projection 30 should be formed. The entangled fiber web 41 can be zig-zag folded without causing such fiber distribution by, for example, controlling the energy applied during hydroentanglement.

In the bulky sheet 10 shown in FIG. 3, the first region 71 includes a plurality of small projections 81. The individual small projections 81 are nearly dome-shaped and hollow. The small projection 81 is a projection of the bulky sheet 10 projecting from the second side 12 toward the first side 11. The small projections 81 are regularly arranged over the entire area of the first region 71. The small projection 81 has a smaller thickness (height) than the second region 72. The presence of the small projections 81 in the first region 71 is advantageous in that the dust trapping capabilities are improved.

The small projection 81 is circular in a plan view preferably with a diameter of 0.5 to 5.0 mm, more preferably 1.0 to 4.0 mm. The small projections 81 are preferably formed to an area ratio of 10% to 90%, more preferably 15% to 70%, to the area of the first region 71 in a plan view.

The bulky sheets 10 according to the embodiments shown in FIGS. 1 to 3 trap relatively small dust particles chiefly in their projections 30. Therefore, in order to enhance the trapping performance for relatively small dust particles, it is advantageous that the bulky sheet 10 has an increased plan-view area of the projections 30 on the first side 11. From this viewpoint, the width Wp (see FIGS. 1) of the projection 30 located between adjacent first recessed ridges 21 is preferably 0.5 to 15 mm, more preferably 2 to 5 mm. In the case where the first side 11 of the bulky sheet 10 has second recessed ridges as hereinafter described, the width of the projection 30 located between adjacent second recessed ridges is preferably in the same range as above. The width Wp of the projection 30 may be set as desired by, for example, properly choosing the type of the patterning member to be used in the hereinafter described preferred method for making the bulky sheet 10. The width Wp of the projection 30 may be measured by cutting the bulky sheet 10 across the thickness, observing the cut surface under a microscope, and analyzing an enlarged image of the cut surface. Specifically, the width Wp is measured on a cross-section in triplicate (n=3) with no load applied under a digital microscope VHX-500 from Keyence at 20× to give an average.

The performance of trapping relatively large dust by the first recessed ridge 21 is influenced by the width, depth, interval, and the like of the recessed ridge 21. The inventors have revealed as a result of their study that bread crumbs or like dust particles are successfully trapped when the first recessed ridge 21 has a width Wg (see FIGS. 1) of 0.5 to 8 mm, more preferably 1 to 4 mm. They have also found that bread crumbs or like dust particles are successfully trapped when the first recessed ridge 21 has a depth D (see FIG. 1) of 0.5 to 6 mm, more preferably 1 to 4 mm. The interval P (see FIG. 1) of adjacent first recessed ridges 21 is preferably 0.825 to 15 mm, more preferably 1.3 to 10.8 mm, even more preferably 2.02 to 9.52 mm, in view of an increased number of hairs that can be trapped through a single cleaning operation. In the case where the first side 11 of the bulky sheet 10 has the hereinafter described second recessed ridge, it is also preferred for the second recessed ridge to have the width, depth, and interval within the respective same ranges as above. A desired width Wg, a desired depth D, and a desired interval P of the first recessed ridge 21 will be achieved by, for example, properly selecting the type of the patterning member to be used and the conditions of hydroentanglement in the hereinafter described preferred method for making the bulky sheet 10. The width Wg, depth D, and interval P of the first recessed ridge 21 may be measured by cutting the bulky sheet 10 across the thickness, observing the cut surface under a microscope, and analyzing an enlarged image of the cut surface. The same applies to the hereinafter described second recessed ridge 22. More specifically, the measurements may be taken in the same manner as for Wp.

In order for the bulky sheets 10 shown in FIGS. 1 through 3 to have enhanced performance of trapping both relatively large dust and relatively small dust, it is important to control the area ratio of the first recessed ridges 21 and the area ratio of the projections 30 relative to the apparent plane-view area of the first side 11 of the bulky sheet 10. From this point of view, the ratio of the area ratio of the first recessed ridges 21 to the area ratio of the projections 30, each relative to the apparent area of the bulky sheet 10, the former/the latter, is preferably 1:0.5 to 1:5, more preferably 1:1.5 to 1:3. In the case where the bulky sheet 10 has the hereinafter described second recessed ridge 22, the ratio of the sum of the area ratio of the first recessed ridges 21 and the area ratio of the second recessed ridges 22 to the area ratio of the projections 30, each relative to the apparent area of the bulky sheet 10, is preferably within the same range as above. These ratios can be obtained by analyzing a plan-view image of the first side 11 of the bulky sheet 10.

The bulky sheet 10 may have a second recessed ridge 22 extending in a second direction as well as the first recessed ridge 21 formed on its first side 11. The second recessed ridge 22 extends in a direction different from the direction in which the first recessed ridge 21 extends. Specifically, the second recessed ridge 22 extends in a direction almost perpendicular to the first recessed ridge 21. The direction in which the second recessed ridge 22 extends is usually coincident with the cross-machine direction (CD) of the bulky sheet 10 being manufactured. The second recessed ridge 22 is a result of the formation of the projections 30 of the bulky sheet 10 projecting from the second side 12 toward the first side 11. The second recessed ridge 22 preferably extends straight. It is desirable that adjacent second recessed ridges 22 be parallel to each other, forming no intersections between themselves. The depth of the second recessed ridge 22 is substantially non-uniform in its extending direction. For example, the depth of the second recessed ridge 22 at the intersection between the first recessed ridge 21 and the second recessed ridge 22 may be different from the depth at other than the intersection. In the embodiment shown in FIG. 2, the second recessed ridge 22 is deeper at the intersections with the first recessed ridges 21 than at other than the intersections. The bulky sheet 10 having the second recessed ridges 22 as well as the first recessed ridges 21 exhibits to advantage further improved performance of trapping relatively large dust particles when used as a cleaning sheet. The width, depth, and interval of the second recessed ridge 22 may be the same as, or different from, the width Wg, depth D, and interval P (see FIG. 1) of the first recessed ridge 21. It is preferred that the interval of the second recessed ridges 22 be 2 to 30 mm, more preferably 4 to 20 mm, even more preferably 6 to 18 mm, in terms of improved performance of trapping relatively large dust.

To form the second recessed ridge 22 in addition to the first recessed ridge 21 provides another advantage that the projections 30 exhibit further enhanced shape retention. In detail, as a result of the formation of the second recessed ridges 22 as well as the first recessed ridges 21, the individual projections 30 are delineated almost as a rectangle in a plan view by intersecting the two kinds of recessed ridges as shown in FIGS. 2(*a*) and 2(*b*). As compared with the projection 30 having the shape of a raised ridge formed by the formation of only the first recessed ridges 21, the rectangle-shaped projection 30 has increased resistance against compression and therefore exhibits improved shape retention. In that case, the length of each side of the plan-view rectangle of the projection 30 is preferably in the same range as the range of Wp recited supra, and the area of the plan-view rectangle of the projection 30 is preferably 0.5 to 300 $mm^2$, more preferably 6 to 155 $mm^2$, provided that the area falls within the product of width Wp of the projection 30 measured between the first recessed ridges 21 and the width Wp of the projection 30 measured between the second recessed ridges 22.

When the bulky sheet 10 has the second recessed ridge 22 in addition to the first recessed ridge 21 on the first side thereof, the first recessed ridge 21 is preferably deeper than the second recessed ridge 22 in a cross-section across the thickness of the bulky sheet 10. Such a profile of the first side provides an advantage that the performance of trapping both relatively large dust and relatively small dust is enhanced.

While the profile of the first side 11 of the bulky sheet 10 is as described above, it is preferred for the second side 12 to have a surface inverted with respect to the three-dimensionally uneven surface of the first side 11. Accordingly, the portions of the second side 12 corresponding to the first recessed ridge 21 on the first side 11 forms a substantially continuous linear projection, and the portion of the second side 12 corresponding to the projection 30 on the first side 11 forms a recess.

The bulky sheet 10 is literally bulky. The bulkiness of the bulky sheet 10 may be represented in terms of apparent density calculated by dividing the basis weight by the apparent overall thickness. The apparent density of the bulky sheet 10 is preferably in the range of from 0.002 to 0.100 $g/cm^3$, more preferably from 0.005 to 0.060 $g/cm^3$. In this connection, the bulky sheet 10 preferably has a basis weight of 25 to 110 $g/cm^2$, more preferably 30 to 80 $g/cm^2$, and an apparent thickness T (see FIGS. 1) of 1.0 to 7 mm, more preferably 1.1 to 5 mm. The apparent thickness T of the bulky sheet 10 is measurable by cutting the bulky sheet along the thickness direction and observing the cut surface as magnified under a microscope, more specifically, in the same manner as for the measurement of Wp.

The fibers that can be used to make up the bulky sheet 10 include fibers of various thermoplastic resins and cellulosic fibers. Examples of the thermoplastic resins include homo- and copolymers of monoolefins, such as ethylene, propylene, and butene. High-density polyethylene, low-density polyethylene, linear low-density polyethylene, polypropylene, ethylene-propylene copolymers, and ethylene-vinyl acetate copolymers are included. Ester homo- and copolymers, such as polyethylene terephthalate and polybutylene terephthalate; vinyl or vinylidene homo- and copolymers, such as polyvinyl chloride and polyvinylidene chloride; polyamides (homo- and copolymers), such as polyamide 6 and polyamide 66; and acrylonitrile homo- and copolymers are also useful. Additionally, PC (polycarbonate), PS (polystyrene), POM (polyacetal), and so on are usable. Two or more kinds of fibers of these resins may be used in combination. The forms of the fibers that can be used include solid, sheath/core, hollow, hollow sheath/core, side-by-side, eccentric, splittable, and combinations thereof. The cross-sectional shapes of the fibers include circles, triangles, stars, and combinations thereof. The cellulosic fibers may be those essentially having hydrophilicity. Examples of such cellulose fibers include natural fibers, such as cotton, pulp, rayon, cuprammonium, Lyocell, and Tencel. These cellulosic fibers may be used either singly or in combination of two or more kinds thereof. A mixture of cellulosic fibers and various thermoplastic resin fibers may be used.

The fibers preferably have a thickness of 0.8 to 30 dtex, more preferably 0.8 to 7 dtex, in view of dust trapping performance and retention of the sheet strength of the bulky sheet 10. The fibers may be continuous filaments or staple fibers in accordance with the method for making the bulky sheet 10. In using the hereinafter described method of making, it is preferred to use staple fibers with a length of 20 to 100 mm, more preferably 30 to 65 mm. A surfactant or lubricant that can improve the surface physical properties of the entangled fiber web or enhance the dust trapping capabilities may be applied to the fiber aggregate.

The bulky sheet 10 may contain a scrim in addition to the above described fibers. A combined use of a scrim increases the strength of the bulky sheet 10. In using a scrim, the fibers constituting the bulky sheet 10 are preferably entangled with not only themselves but the scrim. The scrim is exemplified by a lattice mesh having a strand diameter of 50 to 600 μm and a spacing of 2 to 30 mm between strands.

The scrim preferably has an air permeability of 0.1 to 1000 $cm^3/(cm^2 \cdot sec)$. A material other than scrims, such as nonwoven fabric, paper, or film, may be used as long as its air permeability is in that range. Examples of the material of the scrim include those described in U.S. Pat. No. 5,525,397, col. 3, 11. 39-46.

To increase relatively large dust trapping capability, it is preferred for the bulky sheet 10 to have a KES compression stiffness LC of 0.08 to 0.30(–) and a KES compression work WC of 0.21 to 1.50 ($gf \cdot cm/cm^2$). The bulky sheet 10 satisfying these parameters is easily deformable even under a low load and has good resilience against compression so that it is capable of trapping relatively large dust particles. The KES compression stiffness LC and KES compression work WC are determined as follows. Three specimens measuring 100 mm in width and 100 mm in length are cut out of the bulky sheet 10. The compression stiffness LC and compression work WC of the specimens are measured using a compression tester KES FB3-AUTO-A from Kato Tech Co., Ltd. under conditions of a compression area of 2 $cm^2$, a compression rate of 0.02 mm/sec, and a maximum load of 50 $gf/cm^2$ to obtain an average value (n=3).

The balance between fiber entanglement and fiber shedding is of importance for the bulky sheet 10. Loose fiber entanglement provides increased trapping ability but, in turn, allows the fibers to shed to make the sheet useless. Conversely, strong fiber entanglement, though not causing fiber shedding, provides low trapping ability. Then, it is advisable to mix small diameter fibers or long fibers. Because small diameter fibers or long fibers entangle with relatively low energy, the constituent fibers become less mobile and are thus prevented from shedding. The small diameter fibers or long fibers preferably have a fineness of less than 1.45 dtex or a length of more than 38 mm. The small diameter fibers or long fibers preferably have a solid or sheath/core structure. To achieve fiber shedding prevention, the mixing ratio of the small diameter fibers or long fibers is preferably 1 to 50 mass % based on the whole mass of the bulky sheet 10.

Mixing small diameter fibers can result in a reduction in thickness of the bulky sheet 10. It is therefore preferred to additionally mix large diameter fibers with a larger diameter than the diameter of the small diameter fibers. Such large diameter fibers preferably have a fineness of 5.0 dtex or more and a length of 25 mm or longer. The large diameter fibers may have a solid, sheath/core, modified cross-section, or splittable configuration and preferably have a solid, eccentric, or side-by-side configuration that permits the bulky sheet 10 to have an increased thickness. The mixing ratio of the large diameter fibers is preferably 1 to 50 mass % based on the whole mass of the bulky sheet 10 to provide an increased thickness.

The small diameter fibers, long fibers, and large diameter fibers may have the same resin compositions as those of the previously described fibers.

As another approach to prevent fiber shedding, it is preferable to use sheath/core binder fibers (e.g., PE/PP and PE/PET) as small diameter fibers, long fibers, or large diameter fibers. In this case, PE is fused by heat treatment to prevent fiber shedding.

A preferred method for making the bulky sheet of the invention will then be described. The method includes an entangling step in which high pressure water jets are directed to a fiber web to entangle the constituent fibers to form an entangled fiber web and a three-dimensional patterning step in which the resulting entangled fiber web is placed on a patterning member having apertures in a prescribed pattern and subjected to high pressure water jets to cause part of the entangled fiber web to project into the apertures of the patterning member. The steps proceed in the order described.

Figure 4:
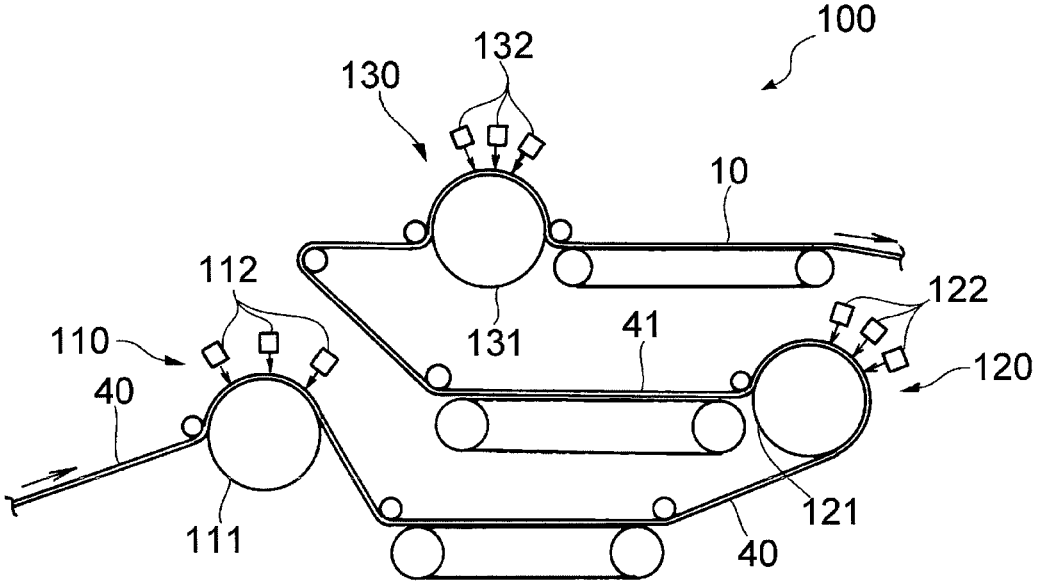
FIG. 4 schematically illustrates an apparatus suited to make the bulky sheet of FIG. 2.

FIG. 4 illustrates an apparatus 100 that is suitably used to implement the method for making the bulky sheet shown in FIGS. 1 and 2. The apparatus 100 is largely sectioned into a first entanglement part 110, a second entanglement part 120, and a three-dimensional patterning part 130.

In the first entanglement part 110, a continuous fiber web 40 is transported to be fed to the periphery of a water permeable drum 111. The first entanglement part 110 has a plurality of nozzles 112 ejecting high pressure water jets at positions facing the periphery of the water permeable drum 111 so that high pressure water jets may be shot from the nozzles 112 to the continuous fiber web 40 on the periphery of the water permeable drum 111, whereby the fibers of the continuous fiber web 40 are entangled to form a continuous fiber web having an increased degree of entanglement.

The continuous fiber web 40 to be transported to the first entanglement part 110 may be prepared by any known web forming process, such as carding. When the continuous fiber web 40 is formed by carding, the fiber orientation direction of the continuous fiber web 40 coincides with the transport direction of the continuous web 40. In making a scrim-containing bulky sheet 10, two continuous fiber webs, which are either the same or different, having a scrim interposed therebetween beforehand are provided and transported to the first entanglement part.

The continuous fiber web 40 having an increased degree of entanglement is then forwarded to a second entanglement part 120. The second entanglement part 120 includes a water permeable drum 121 and a plurality of high pressure water jet nozzles 122. The nozzles 122 are arranged to face the periphery of the water permeable drum 121. The continuous fiber web 40 is turned over when fed to the second entanglement part 120 so that the side of the web 40 opposite to the side having been subjected to the high pressure water jets in the first entanglement part 110 may face the nozzles 122. In that state, high pressure water jets are shot from the nozzles 112 to the continuous fiber web 40, whereby the constituent fibers are further entangled to achieve a further increased degree of entanglement.

In the instant method, high pressure water jets are directed to each side of the continuous fiber web 40 to carry out fiber entanglement. The degree of fiber entanglement can be controlled by adjusting the water pressure of the high pressure water jets.

As a result of the fiber entanglement in the second entanglement part 120, there is obtained an entangled fiber web 41 having sufficiently enhanced shape retention. The entangled fiber web 41 is hydroentangled nonwoven fabric. The resulting entangled fiber web 41 is fed to a three-dimensional patterning part 130. The three-dimensional patterning part 130 has a drum-shaped patterning member 131. The three-dimensional patterning part 130 also has a plurality of high pressure water jet nozzles 132 arranged to face the periphery of the drum-shaped patterning member 131 such that high pressure water jets from the nozzles 132 are directed to the entangled fiber web 41 wrapping the drum-shaped patterning member 131. On receiving the high pressure of the high pressure water jets, the entangled fiber web 41 is three-dimensionally patterned to give a desired bulky sheet 10.

The nozzle 132 to be used is not particularly limited. For example, the nozzle disclosed in JP 53-14874A may be used, in which a plurality of orifices with a diameter, e.g., of 0.15 mm are arranged at an interval, e.g., of 1 mm. In order to prevent fiber shedding, a nozzle having orifices arranged in a staggered pattern, a multi-row nozzle, a gradation nozzle, and the like may be used. A multi-row nozzle is a nozzle having two or more orifices aligned at a given pitch in the machine direction. A gradation nozzle is a nozzle having an increasing and/or decreasing number of orifices in the width direction or a repetition of such an orifice arrangement. The nozzle orifices may be partly shielded to direct high pressure water jets in stripes.

The bulky sheet 10 obtained by the three-dimensional patterning in the three-dimensional patterning part 130 is turned over to provide the side having been facing the drum-shaped patterning member 131 as the first side 11, which serves as, for example, a working face of a cleaning sheet.

Figure 5A:
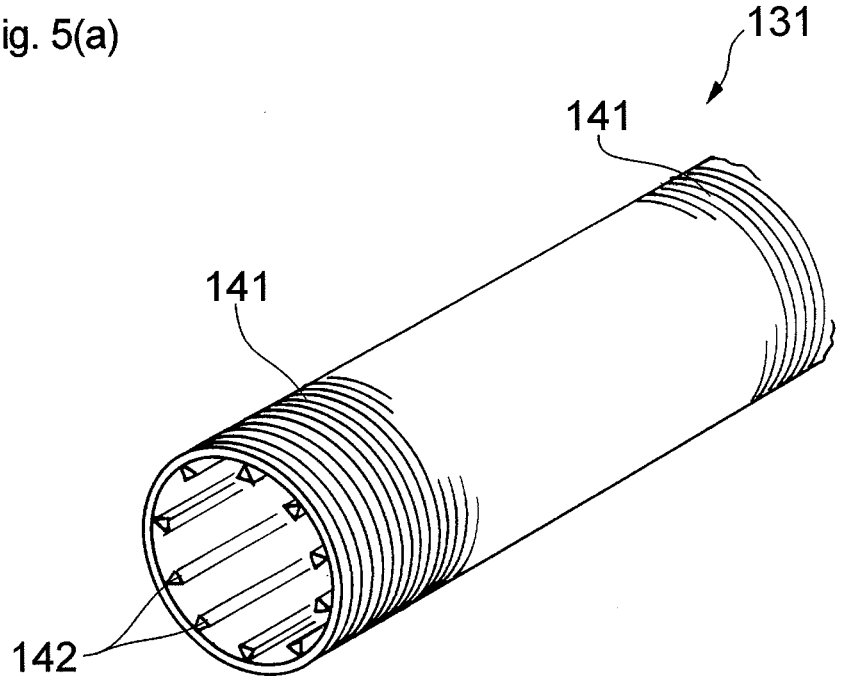
FIG. 5(*a*) presents an exterior view of a drum-shaped patterning member installed in the three-dimensional patterning part of the apparatus shown in FIG. 4.
Figure 5B:
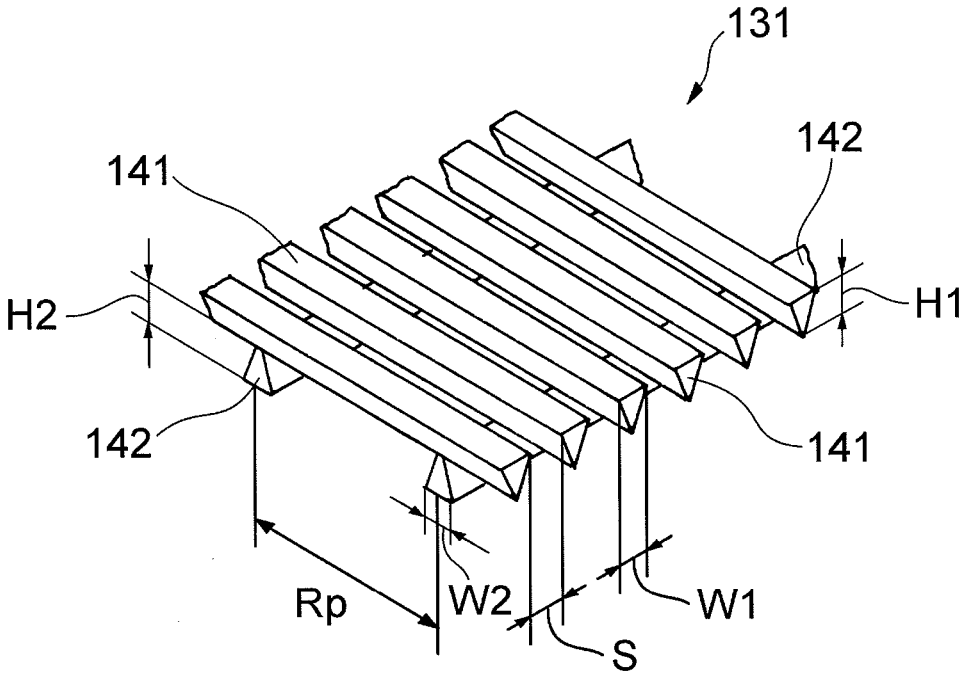

FIG. 5(*a*) presents an exterior view of the drum-shaped patterning member 131 installed in the three-dimensional patterning part 130. FIG. 5(*b*) is a perspective of a part of the drum-shaped patterning member shown in FIG. 5(*a*) in an opened and flattened state. As shown in FIGS. 5(*a*) and 5(*b*), the patterning member 131 has a plurality of first wire-like members 141 that extend in one direction (the drum rotating direction in FIG. 5(*a*)) and are arranged at a predetermined spacing and a plurality of second wire-like members 142 that extend in a direction substantially perpendicular to the first wire-like members 141 (the drum axial direction in FIG. 5(*a*)) and are arranged at a predetermined spacing. The second wire-like members 142 underlie the first wire-like members 141 (radially inwardly from the first wire-like members 141 in FIG. 5(*a*)). Therefore, in a plan view of the patterning member 131 there provided is a lattice formed of the first wire-like members 141 and the second wire-like members 142 and having a plurality of nearly rectangular apertures defined by the first wire-like members 141 and the second wire-like members 142. A patterning member having such a structure is available, e.g., from Johnson Screens Japan. Preferred but non-limiting examples of the material of the patterning member include stainless steel (e.g., SUS 304, 316, and 316L), Hastelloy, and titanium in terms of strength. Plastics, such as ABS and PVC, may be used.

Figure 6A:
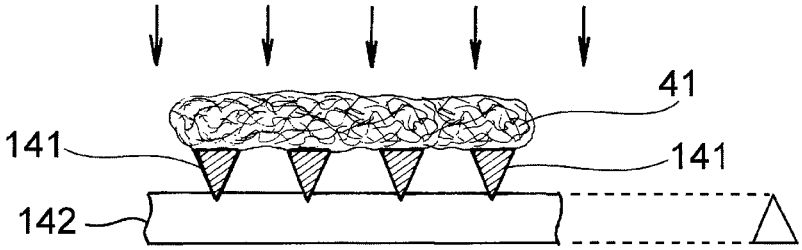
FIG. 6(*a*), FIG. 6(*b*), and FIG. 6(*c*) are each a schematic diagram showing an entangled fiber web being three-dimensionally patterned using the patterning member of FIGS. 5(*a*) and 5(*b*).
Figure 6B:
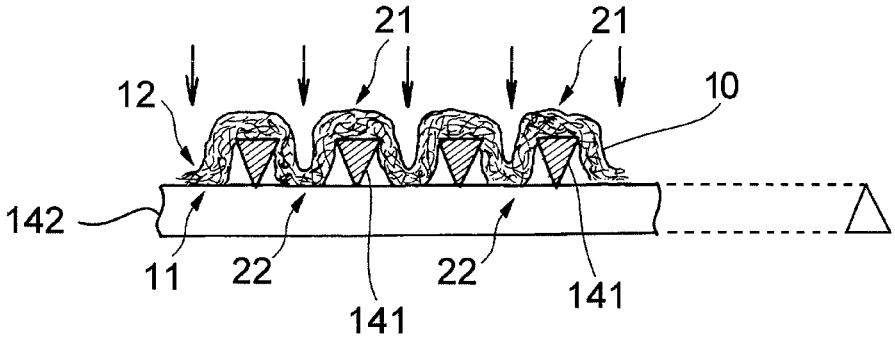
Figure 6C:
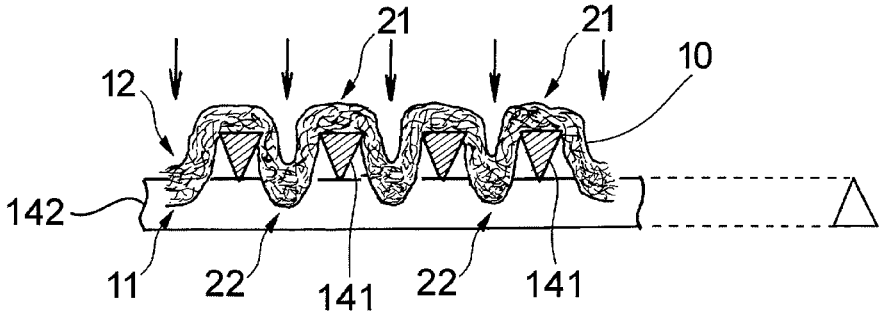

FIGS. 6(*a*) through 6(*c*) are each a schematic diagram showing the entangled fiber web 41 being three-dimensionally patterned using the drum-shaped patterning member 131 shown in FIGS. 5(*a*) and 5(*b*). FIGS. 6(*a*) through 6(*c*) are views from a direction facing the rotating direction of the patterning member 131, i.e., the transport direction of the entangled fiber web 41. That is, the patterning member 131 is rotating in the direction perpendicular to the plane of the drawing of FIGS. 6. FIG. 6(*a*) shows the entangled fiber web 41 immediately after it is fed to the patterning member 131, and FIGS. 6(*b*) and 6(*c*) show the entangled fiber web 41 being three-dimensionally patterned by high pressure water jets directed thereto. FIG. 6(*b*) shows the entangled fiber web 41 being three-dimensionally patterned at the positions of the second wire-like members 142. FIG. 6(*c*) shows the entangled fiber web 41 being three-dimensionally patterned between adjacent second wire-like members 142.

When high pressure jets of water from unshown nozzles are directed to the entangled fiber web 41 fed to the patterning member 131 as shown in FIG. 6(*a*), fibers in the portions of the entangled fiber web 41 located on the first wire-like members 141 are hardly moved (re-arranged) because of the restraint by the first wire-like members 141 as shown in FIGS. 6(*b*) and 6(*c*). On the other hand, the portions of the entangled fiber web 41 located between adjacent first wire-like members 141 are pressed and projected by the high pressure water jets into the nearly rectangular apertures defined by the first wire-like members 141 and the second wire-like members 142. Here, the degree of projection of the entangled fiber web 41 at the locations of the second wire-like members 142 is limited by the presence of the second wire-like members 142 as shown in FIG. 6(*b*), while the portions of the entangled fiber web 41 located between adjacent second wire-like members 142 are allowed to be projected to a higher degree than that shown in FIG. 6(*b*) because of the absence of members that restrain the projecting. As stated above, after completion of the three-dimensional patterning, the resulting bulky sheet 10 is turned over to provide the side having been facing the patterning member 131 as the first side 11. The bulky sheet 10 shown in FIGS. 6(*b*). and 6(*c*) lies in a reversed relation with respect to the bulky sheet 10 shown in FIG. 1. That is, the portions of the entangled fiber web 41 restrained by the first wire-like members 141 from projecting as shown in FIGS. 6(*a*) and 6(*b*) become the first recessed ridges 21 of a bulky sheet 10 to be produced, and the portions allowed to project without restraint in FIG. 6(*c*) become the projections 30 of a bulky sheet 10 to be produced. The portions allowed to project to a limited degree in FIG. 6(*b*) become the second recessed ridges 22 of a bulky sheet 10 to be produced. In the present embodiment, the depth of the second recessed ridges 22 is smaller than that of the first recessed ridges 21.

A desired bulky sheet 10 is thus obtained. In this particular embodiment of the method, the first wire-like members 141 and the second wire-like members 142 have a nearly triangular cross-section, each first wire-like member 141 being disposed with its triangular cross-section pointing down, while each second wire-like member 142 being disposed with its triangular cross-section pointing up. The nearly triangular shape is preferably an isosceles, equilateral, or right triangle. The triangle may have a projection, relief pattern, or depression on its base. By using first and second wire-like members 141 and 142 having such a profile, the first recessed ridges of the resulting bulky sheet 10 will have an additional recess, pattern, or projection, which further enhances the dust trapping performance to advantage.

In particular, each first wire-like member 141 has a down-pointing isosceles triangular cross-section, and each second wire-like member 142 has an up-pointing isosceles triangular cross-section as shown in FIGS. 5(*a*) and 5(*b*). By arranging the first wire-like members 141 having an isosceles triangular cross-section with their triangular cross-section pointing down, the entangled fiber web 41 will have an inverted omega shaped cross-section so that relatively large dust particles may be trapped to advantage between adjacent omega shapes.

The space S (see FIG. 5(*b*)) between adjacent triangles of the first wire-like members 141 may be adjusted as appropriate to the size of dust to be trapped. The pitch Rp of the triangles of the second wire-like members 142 may be adjusted as appropriate to the shape retention and resistance to compression of a bulky sheet 10 to be produced.

Using such wire-like members 141 and 142 allows for easy formation of a desired bulky sheet 10 having macroscopic projections 30 and recessed ridges 21 and 22. It is not easy with any other patterning member, for example, the patterning member described in patent literature 1 to form such distinct projections 30 and recessed ridges 21 and 22 as achieved by the method of the invention.

While in the present embodiment of the method both the first wire-like members 141 and the second wire-like members 142 have a nearly triangular (e.g., a isosceles, equilateral, or right triangular) cross-section, the cross-sectional shape of these wire-like members is not limited thereto. That is, the first wire-like members 141 and/or the second wire-like members 142 may have a triangular cross-section and be arranged with the triangles pointing up or down. It is preferred for at least the first wire-like members 141, which contact with the entangled fiber web 41, to have a triangular cross-section.

When both the first wire-like members 141 and the second wire-like members 142 have a triangular cross-section, the structures the patterning member 131 may have include not only the structure described above but also the structures shown in FIGS. 7(*a*) through 7(*c*). The patterning member 131 shown in FIG. 7(*a*) has the first wire-like members 141 arranged with their triangular cross-section pointing down and the second wire-like members 142 similarly arranged with their triangular cross-section pointing down. The second recessed ridges 22 formed by using this patterning structure will have a larger width than those formed by using the patterning structure of FIGS. 5(*a*) and 5(*b*). This is advantageous in making it easier for relatively large dust particles to enter in a cleaning operation.

Figure 7A:
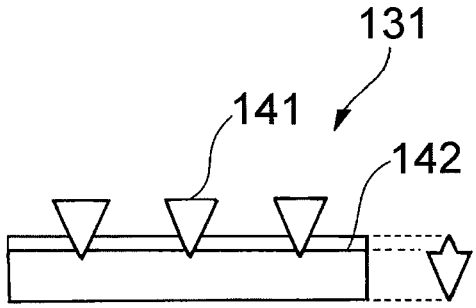
FIGS. 7(*a*), 7(*b*), and 7(*c*) each schematically show an arrangement of first wire-like members and second wire-like members in a patterning member.
Figure 7B:
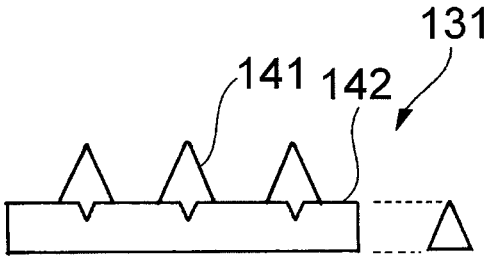
Figure 7C:
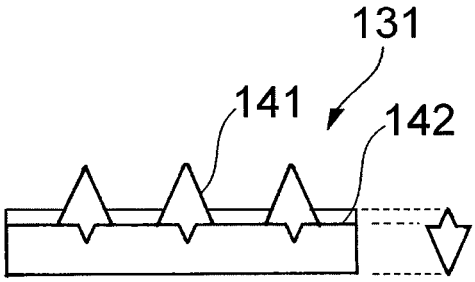
Figure 8A:
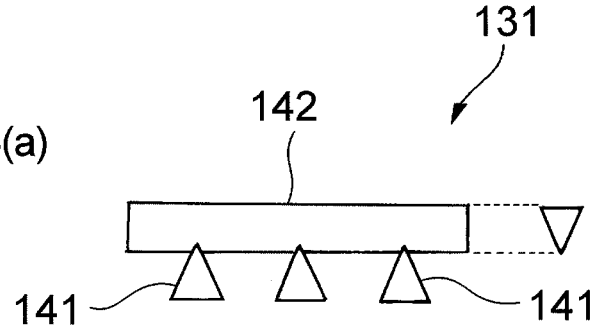
FIG. 8(*a*), FIG. 8(*b*), FIG. 8(*c*), and FIG. 8(*d*) each schematically show an arrangement of first wire-like members and second wire-like members in a patterning member.
Figure 8B:
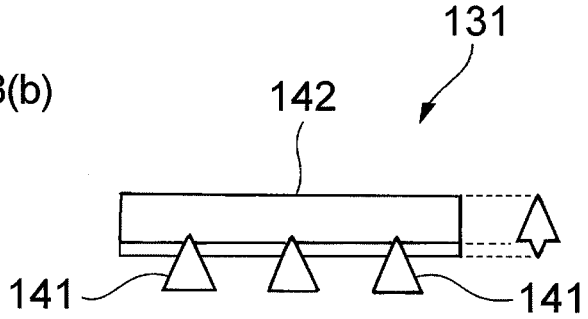
Figure 8C:
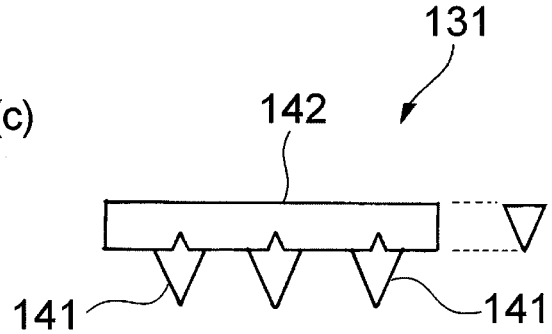
Figure 8D:
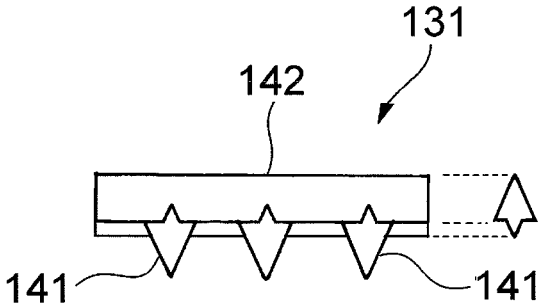

The patterning member 131 shown in FIG. 7(*b*) has the first wire-like members 141 arranged with their triangular cross-section pointing up and the second wire-like members 142 similarly arranged with their triangular cross-section pointing up. The patterning structure of FIG. 7(*b*), in which the first wire-like members 141 are arranged with their isosceles triangular cross-section pointing up, is advantageous in that fibers are less liable to fall off from the entangled fiber web 41 or cling to the patterning member 131 during the production of a bulky sheet than with the patterning structure of FIGS. 5(*a*) and (*b*), in which the first wire-like members 141 are arranged with their isosceles triangular cross-section pointing down.

The patterning member 131 shown in FIG. 7(*c*) has the first wire-like members 141 arranged with their triangular cross-section pointing up and the second wire-like members 142 arranged with their triangular cross-section pointing down. The second recessed ridges 22 formed by using this patterning structure will have a larger width than those formed by using the patterning structure shown in FIG. 7(*b*). This is advantageous in that relatively large dust particles are allowed to easily enter there in a cleaning operation.

Patterning members having an inverted structure with respect to the patterning members shown in FIGS. 5(*a*) and 5(*b*) and FIGS. 7(*a*) through 7(*c*) may be used. FIGS. 8(*a*) through 8(*d*) illustrate cross-sections of patterning members having an inverted structure with respect to those of FIGS. 5(*a*) and 5(*b*) and FIGS. 7(*a*) to 7(*c*), respectively. In these cases, because the second wire-like members 142 are arranged on the side facing the entangled fiber web 41, the formed second recessed ridges 22 are deeper and denser than the first recessed ridges 21. Furthermore, the fibers are densified in the width direction (cross-machine direction during the production) so that fall-off of fibers reduces to advantage.

While in FIGS. 5(*a*) and 5(*b*) and 7(*a*) to 7(*c*) the direction in which the first wire-like members 141 extend is coincident with the rotational direction of the patterning member 131, i.e., the transport direction of the entangled fiber web 41, the patterning member 131 may be disposed such that the direction in which the first wire-like members 141 extend is perpendicular to the transport direction of the entangled fiber web 41. In this case, the direction in which the second wire-like members 142 extend coincides with the transport direction of the entangled fiber web 41. As a result, first recessed ridges 21 are formed along a direction perpendicular to the fiber orientation direction, which is advantageous to prevent fiber shedding.

In a modification of the patterning member 131, the first wire-like members 141 or second wire-like members 142 may be arranged at a varying interval, in which case the resulting bulky sheet 10 will have alternate large and small projections so that relatively small dust may be trapped between the small and large projections and relatively large dust may be trapped between the large projections.

In another modification, the patterning member 131 may have a gradation structure, i.e., a portion in which the first wire-like members 141 align at a gradually decreasing or increasing interval in the direction of alignment, or the second wire-like members 142 align at a gradually decreasing or increasing interval in the direction of alignment. Taking for instance the patterning member 131 of FIGS. 5(*a*) and 5(*b*), the interval of the first wire-like members 141 may gradually decrease or increase from the middle to both ends in the axial direction of the drum. Otherwise, the interval of the first wire-like members 141 may gradually decrease or increase from one end to the other in the axial direction of the drum. By arranging the first wire-like members 141 in that fashion, the width Wp of the projections 30 to be formed can be varied gradually in the direction perpendicular to the transport direction in the production. Thus, a bulky sheet 10 having a gradation profile is obtained, of which the projections and the recessed ridges have a gradually changing size. When used as a wiper, such a bulky sheet 10 will bring its projections into overall contact with the surface being cleaned to efficiently trap from small to large dust particles.

Whichever of the above discussed structures the patterning member 131 may take, the triangular cross-sections of the first wire-like member 141 and the second wire-like member 142 composing the patterning member 131 preferably have a base length $W_1$ and $W_2$, respectively, of 0.4 to 7 mm, more preferably 0.5 to 5 mm. The base lengths of the triangles are a factor decisive of the widths of the first and the second recessed ridges, respectively, of the bulky sheet 10. The heights $H_1$, $H_2$ of the respective triangles are preferably 1.0 to 10 mm, more preferably 1.5 to 7 mm. The first wire-like member 141 and the second wire-like member 142 may be either the same or different in size.

The sum of the space S between adjacent first wire-like members 141 and the base length $W_I$ corresponds to the interval P of the first recessed ridges 21 of the resulting bulky sheet 10. The space S between adjacent first wire-like members is preferably 0.025 to 15 mm, more preferably 0.1 to 10 mm, even more preferably 0.5 to 8 mm, taking into consideration the balance between minimum degree of fiber entanglement during three-dimensional patterning and prevention of fiber shedding. These parameters are influential on the number of hairs that can be trapped through a single cleaning operation.

The pitch Rp of the triangles of the second wire-like members 142 corresponds to the distance between adjacent second recessed ridges 22 of the resulting bulky sheet 10. The pitch Rp of the triangles is preferably 2 to 30 mm, more preferably 4 to 20 mm, even more preferably 6 to 18 mm, in the interests of relatively large dust trapping performance.

The open area ratio OA is calculated from formula: $OA(\%)=S/(S+W_1)\times 100$, where $W_1$ is the base length of the triangle of the first wire-like member 141, which directly faces the entangled fiber web 41, of the patterning member 131; and S is the space between adjacent triangles. In the invention, the open area ratio OA is preferably 5% to 90%, more preferably 10% to 85%.

Figure 9:
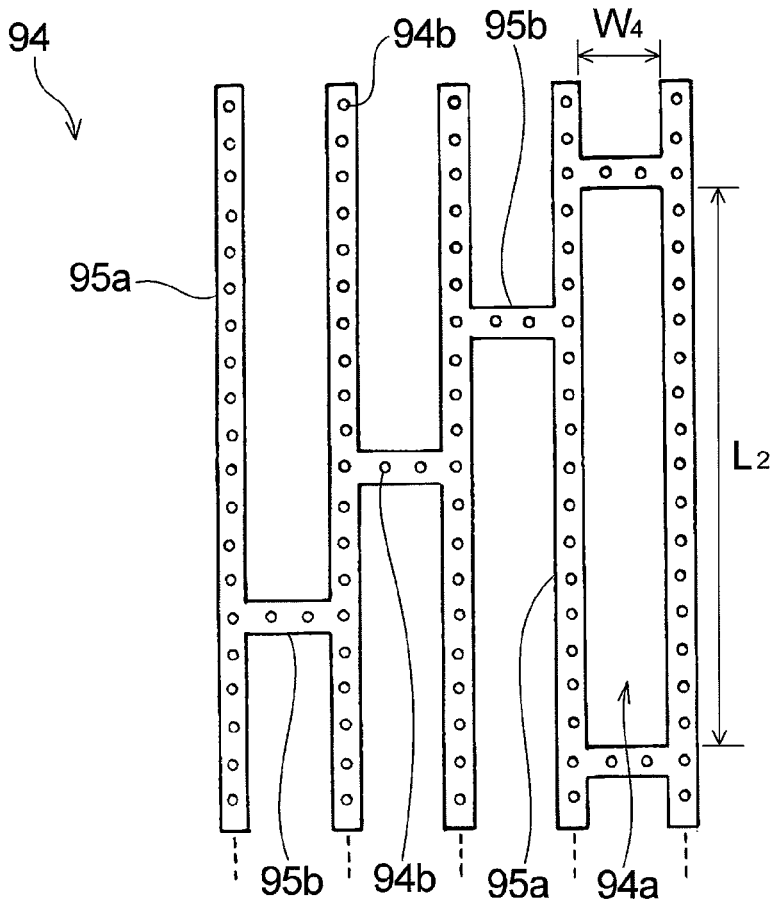
FIG. 9 illustrates a second patterning member of another embodiment of the three-dimensional patterning part of FIG. 4.
Figure 10:
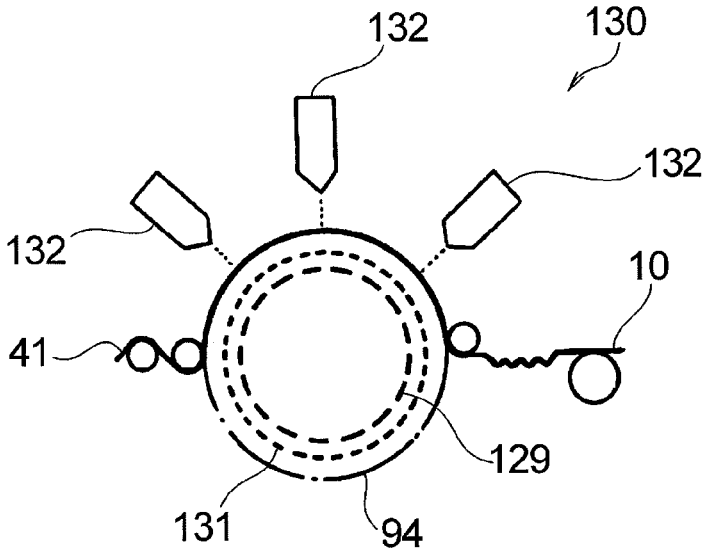
FIG. 10 is a schematic enlarged view of an essential part of another embodiment of the three-dimensional patterning part of FIG. 4.

In another embodiment of the production method of the invention, a combination of a first patterning member, such as the patterning member 131 shown in FIG. 5, and a second patterning member 94, such as the one shown in FIG. 9 (for example, a circular-perforated punching plate having a pattern of openings), fixed onto the first patterning member 131 is used as a three-dimensional patterning member. The entangled fiber web 41 is placed on the thus constructed three-dimensional patterning member and subjected to high pressure water jets. High pressure water jets being directed to the entangled fiber web are shown in FIG. 10, in which the essential part of the three-dimensional patterning part 130 is enlargedly shown. The three-dimensional patterning part 130 includes a drum 129, the first patterning member 131 having a plurality of projections and recesses disposed along the peripheral surface of the drum 129, and the second patterning member 94 having a plurality of openings disposed on the first patterning member 131 along the peripheral surface of the drum 129. In this embodiment, a nozzle having an orifice partly shielded (not shown) may be used to apply water jets in stripes.

As shown in FIG. 9, the second patterning member 94 composing the three-dimensional patterning part 130 is a plate having a rectangular lattice pattern. The pattern of the second patterning member 94 is not limited thereto (see FIG. 12, which will be described later). The second patterning member 94 is composed of a first region 95*a* extending in the fiber orientation direction and a second region 95*b* extending in the direction perpendicular to the direction in which the first region 95*a* extends. When the distance between adjacent second regions 95*b* is longer than that between adjacent first regions 95*a*, the second patterning member 94 has a plurality of the first regions 95*a* extending over a length $L_2$ of preferably 286 mm or longer, more preferably 286 to 400 mm, even more preferably 286 to 310 mm, in direct distance in the fiber orientation direction of the entangled fiber web 41. The individual first regions 95*a* extend straight with a prescribed width. The first regions 95*a* extend in the same direction as the rotational direction of the drum 129 of the three-dimensional patterning part 130. The rotational direction is coincident with the fiber orientation direction of the entangled fiber web 41. When the distance between adjacent first regions 95*a* is longer than that between adjacent second regions 95*b*, the maximum distance $W_4$ between adjacent first regions 95*a* in the direction perpendicular to the extending direction of the first regions 95*a* is preferably 206 mm or more, more preferably 206 to 300 mm, even more preferably 206 to 225 mm. The first regions 96*a* adjacent to each other are interconnected via the second region 95*b* arranged in between. The second region 95*b* has the same or different width from that of the first region 95*a* and extends straight in the direction perpendicular to the extending direction of the first region 95*a*. One second region 95*b* interconnects only two first regions 95*a* adjacent to each other and does not interconnect more than two adjacent first regions 95*a*. There is a rectangular opening 94*a* defined by a single lattice composed of first regions 95*a* and second regions 95*b* in the second patterning member 94. That is, the second patterning member 94 has a plurality of openings 94*a*. Independently of the openings 94*a*, the first region 95*a* and the second region 95*b* each have regularly arranged perforations 94*b*. The individual perforations 94*b* are smaller in size than the openings 94*a*. Each perforation 94*b* has a circular plan-view shape preferably with a diameter of 0.5 to 5.0 mm, more preferably 1.0 to 4.0 mm. The area ratio of the perforations 94*b* is preferably 10% to 90%, more preferably 15% to 70%, relative to the area of the first region 95*a*.

The second patterning member 94 preferably has a thickness of 0.1 to 10 mm, more preferably 0.5 to 6 mm, even more preferably 1 to 3 mm, in terms of strength and patterning performance. The first region 95*a* and the second region 95*b* preferably independently have a width of 1 to 10 mm, more preferably 1.5 to 6 mm, even more preferably 2 to 5 mm, in terms of strength and drainage.

The second patterning member 94 may be made of metal, such as stainless steel, or plastics. It is preferably made of metal in view of durability. Having the perforations 94*b*, the second patterning member 94 has water permeability. The second patterning member 94 shown in FIG. 9 is used in making the bulky sheet shown in FIGS. 3(*a*) and 3(*b*).

Figure 11:
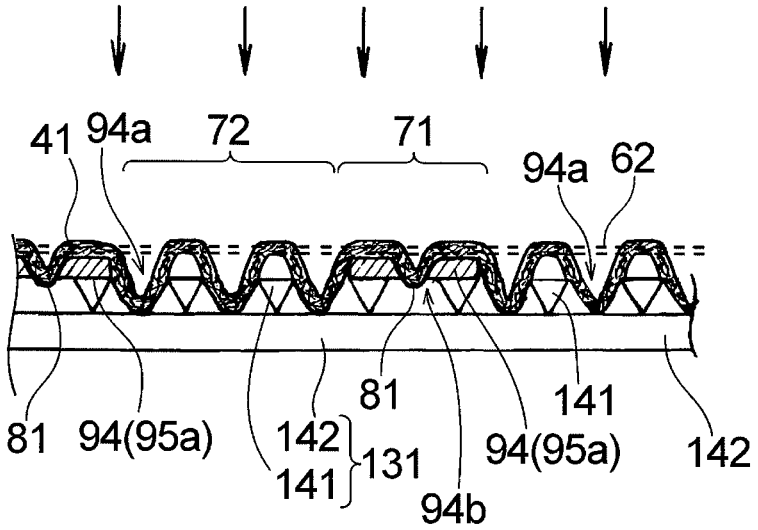
FIG. 11 shows three-dimensional patterning in another embodiment of the three-dimensional patterning part of FIG. 4.
Figure 12A:
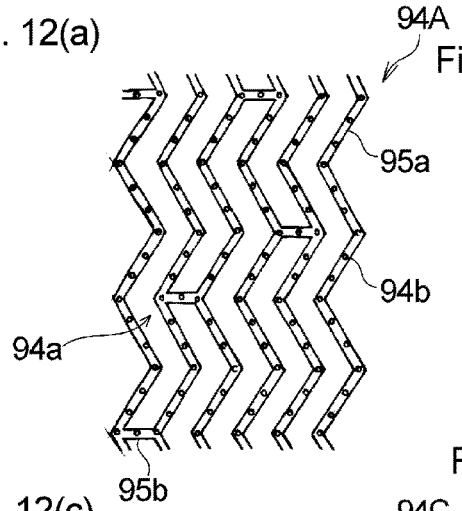
FIG. 12 illustrates a second patterning member of another embodiment of the three-dimensional patterning part of FIG. 4.
Figure 12B:
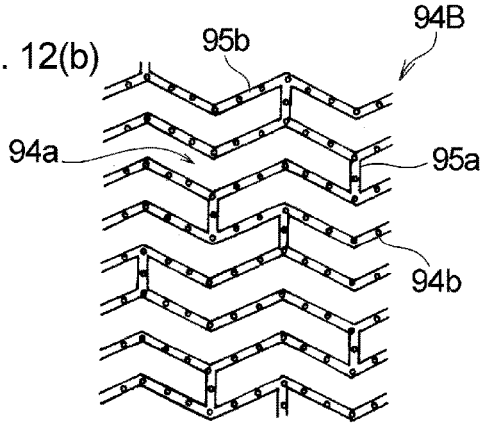
Figure 12C:
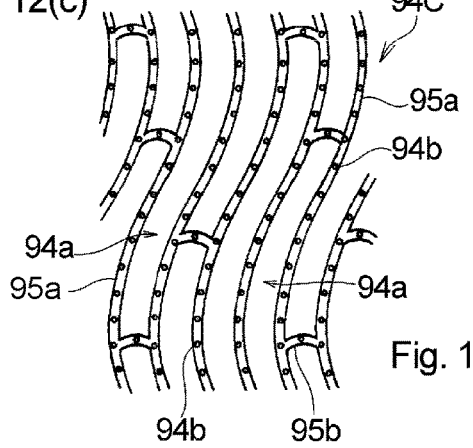
Figure 12D:
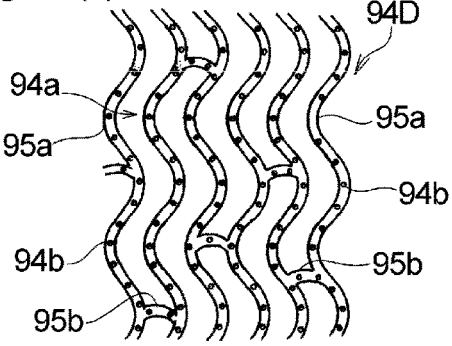
Figure 12E:
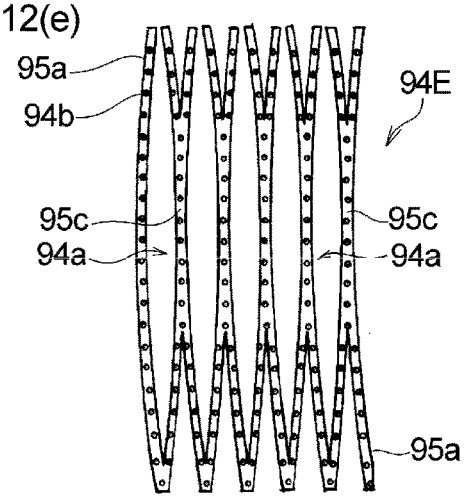

FIG. 11 illustrates an entangled fiber web 41 being three-dimensionally patterned using a three-dimensional patterning member composed of the drum-shaped first patterning member 131 of FIGS. 5(*a*) and (*b*) and the second patterning member 94 of FIG. 9 fitted on the first patterning member 131. FIG. 11 illustrates the process of three-dimensional patterning in making the bulky sheet shown in FIG. 3. The three-dimensional patterning member is installed in the three-dimensional patterning part 130 of the apparatus 100 shown in FIG. 4. As shown in FIG. 11, high pressure jets of water spouted from the nozzles 132 are directed to the entangled fiber web 41 placed on the three-dimensional patterning member, thereby to press the entangled fiber web 41 in parts. The high pressure water jets cause parts of the entangled fiber web 41 to project into the recesses of the first patterning member 131 that are exposed in the openings 94*a* (see FIG. 9) of the second patterning member 94. There are thus formed the second regions 72 including the projections 30 and the first recessed ridges 21 shown in FIG. 3. Since the second regions 72 are a result of projecting the entangled fiber web 41, the second regions 72 have a lower fiber density than before the water jetting.

On the other hand, the portions of the entangled fiber web 41 that are located on the second patterning member 94 are restricted by the second patterning member 94 from projecting even on being subjected to the high pressure water jets. The portions of the entangled fiber web located at the perforations 94*b* (see FIG. 9) of the second patterning member 94 are projected by the high pressure water jets, nevertheless. There are thus formed first regions 71 having a plurality of small projections 81. The fiber density of the first regions 71 where the entangled fiber web has been restricted from projecting is almost the same as that before directing the water jets. There is thus produced the bulky sheet shown in FIG. 3.

As described, three-dimensionally textured bulky sheets 10 as shown in FIGS. 1 to 3 are obtained through the operations shown in FIGS. 4 through 11. In the bulky sheet 10 of FIG. 3, the geometry of the projections 30 of the second regions 72 are decided by the type of the first patterning member 131 and the entangling energy of the high pressure water jets applied to the entangled fiber web 41 in the entanglement parts 110 and 120 and the three-dimensional patterning pat 130. The entangling energy is controlled by the shape of the water jet nozzles and conditions including pitch of the nozzles, water pressure, the number of the nozzles, and line speed.

In carrying out the above discussed operations, the continuous fiber web 40 is transported in one direction to give a continuous bulky sheet, which is later cut crosswise into cut sheets. It is preferred that the continuous bulky sheet be crosswise cut at selected positions such that any second region 72 shown in FIG. 3 in every cut bulky sheet may not be completely surrounded by the first regions 71. It is only necessary that the continuous bulky sheet be cut at least crosswise. When the continuous bulky sheet has a large width, it may be slit lengthwise where needed as well as crosswise. Lengthwise slitting may be carried out along one or more than one lines.

According to the method of the invention, the three-dimensional patterning in the three-dimensional patterning part 130 is preferably achieved by directing high pressure water jets to apply an energy E satisfying the following condition: 200 (kJ/kg)<E<1500 (kJ/kg), more preferably 300 (kJ/kg)<E<1200 (kJ/kg), in order to create sufficient bulkiness, prevent fiber fall-off and hole formation during three-dimensional patterning, and secure sufficient sheet strength. The energy E can be calculated from formula:

$$\text{Energy } E\ (\text{kJ/kg}) = n\rho v^2 Ca/2VB\sqrt{(2P/\rho)}$$

where n is the number of orifices per meter in the width direction of a nozzle (/m); ρ is the density of water (kg/m$^3$); v is the velocity of water at the tip of the nozzle (m/sec); C is a discharge coefficient due to energy loss (0.59 to 0.68 in the case of water); a is the cross-sectional area of the tip of the nozzle (m$^2$); V is the velocity of the web being processed (m/sec); B is the basis weight of the web (g/m$^2$); and P is the water pressure in the nozzle (Pa).

The bulky sheet 10 obtained after the three-dimensional patterning by hydroentanglement is then dried and wound into a mother roll, which is slit crosswise (in the direction perpendicular to the fiber orientation direction with a given width according to use. For use as a cleaning sheet, the slit width is preferably, for example, 205 mm, taking it into consideration that the cut sheet is used as attached to a cleaning tool. The slit bulky sheet 10 is then coated with an oil, cut along the orientation direction, folded, and packaged in a pillow bag to provide a dry sheet package as a final product using a product processing machine. For use as a cleaning sheet attached to a cleaning tool, the cut bulky sheet preferably has a length, e.g., of 285 mm in the fiber orientation direction.

The bulky sheet 10 produced by the above described method is suited for use as not only a dry type cleaning sheet but a hygienic articles, such as a mask or gauze. When the bulky sheet 10 is used as a cleaning sheet, it is preferred to use the first side 11 as a working face.

While the invention has been described with reference to its preferred embodiments, the invention is not construed as being limited to these embodiments. For example, while both the first wire-like members 141 and the second wire-like members 142 composing the patterning member 131 used in the embodiments described have a triangular cross-section, they may have other cross-sectional shapes, such as a circular, elongated circular, tetragonal, rectangular, stilliform shape. The extending direction of the first wire-like members 141 and the extending direction of the second wire-like members 142 do not need to be substantially perpendicular to each other. It is only necessary that these directions be different.

In the case when the bulky sheet 10 does not have second recessed ridges, the patterning member 131 includes the first wire-like members 141 but does not include the second wire-like members 142. In this case, the first wire-like members 141 are supported by any known means.

While in the above embodiments the first wire-like members 141 are underlain by the second wire-like members 142, the second wire-like members 142 may be replaced with other support, such as a water permeable material having a plurality of apertures, such as a punching plate or a wire mesh.

While in the above embodiments the three-dimensional patterning in the three-dimensional patterning part 130 is conducted on only one side of the entangled fiber web 41 as shown in FIG. 4, the three-dimensional patterning may be effected on both sides. This can be achieved by partly masking one side of the entangled fiber web 41, three-dimensionally patterning the unmasked portion of that side, partly masking the other side of the entangled fiber web 41, and three-dimensionally patterning the unmasked portion of the other side.

The pattern of the second patterning member 94 shown in FIG. 9 may be replaced with any of the patterns shown in FIGS. 12(*a*) through 12(*e*). The second patterning member 94A shown in FIG. 12(*a*) has a first region 95*a* extending in a zig-zag fashion. The second patterning member 94B shown in FIG. 12(*b*) is a 90-degree rotated version of the second patterning member 94A of FIG. 12(*a*). The second patterning member 94C shown in FIG. 12(*c*) has a first region 95*a* extending in a wavy form. The second patterning member 94D shown in FIG. 12(*d*) has a first region 95*a* extending in a wavy form similarly to the embodiment of FIG. 12(*c*), but the frequency of the wave form in FIG. 12(*d*) is smaller than that in FIG. 12(*c*). In the second patterning members 94A, 94C, and 94D, the first region 95*a* extends in the fiber orientation direction over a direct distance of 286 mm or more between adjacent second regions 95*b*. In the second patterning member 94B shown in FIG. 12(*b*), on the other hand, the second region 95*b* extends over a direct distance of 206 mm or more between adjacent first regions 95*a*. While the second patterning members 94A to 94D have the first regions 95*a* and the second regions 95*b*, the second patterning member 94E has only first regions 95*a* and does not have second regions 95*b*. Each first region 95*a* of the second patterning member 94E depicts a mildly waving curve, and every pair of adjacent first regions 95*a* are interconnected along their crests to form a junction 95*c*. In the second patterning member 94E, the first region 95*a* extends in the fiber orientation reaction over a direct distance of 286 mm or more in each junction 95*c*.

Based on the above discussed embodiments, the invention discloses the following bulky sheets and methods for making them.

[1] A method for making a bulky sheet comprising directing high pressure water jets to a fiber web to entangle the fibers of the fiber web with themselves to form an entangled fiber web, placing the entangled fiber web on a first patterning member having apertures in a predetermined pattern, and subjecting the entangled fiber web placed on the first patterning member to high pressure water jets to cause part of the entangled fiber web to project into the apertures of the first patterning member, the first patterning member comprising a plurality of first wire-like members extending in one direction and arranged at a predetermined spacing and a support having a plurality of openings, and the support underlying the plurality of first wire-like members.

[2] The method according to [1], wherein the constituent fibers of the fiber web are further entangled with a scrim by the high pressure water jets to form the entangled fiber web.

[3] The method according to [1] or [2], wherein a three-dimensional patterning member having the first patterning member and a second patterning member disposed on the first patterning member is used, and the high pressure water jets are directed to the entangled fiber web placed on the three-dimensional patterning member, the second patterning member has a plurality of first regions extending in the orientation direction of the fibers and a plurality of second regions extending in the direction perpendicular to the direction in which the first region extends, the first regions adjacent to each other are interconnected via the second region arranged in between or interconnected to form a junction, thereby to provide the second patterning member with a plurality of openings, each first region extends over a direct distance of 286 mm or longer in the fiber orientation direction when the distance between the second regions adjacent to each other is longer than that between the first regions adjacent to each other, or each second region extends over a direct distance of 206 mm or more in the direction perpendicular to the direction in which the first regions extend when the distance between the first regions adjacent to each other is longer than that between second regions adjacent each other, the portion of the entangled fiber web that is located on the second patterning member forms a first region, and the portion of the entangled fiber web that is located on the opening of the second patterning member is three-dimensionally shaped in conformity to a recess exposed in the opening to form a second region delineated by the first region.

[4] The method according to [3], wherein the fiber web has a continuous form and is transported in one direction to form the bulky sheet of continuous form, and the continuous form bulky sheet is cut at least crosswise to obtain a cut bulky sheet, the cutting is at a selected position such that the second region in the cut bulky sheet is not completely surrounded by the first regions.

[5] The method according to [3] or [4], wherein, the first regions extend over a direct distance of 286 mm, preferably 286 to 400 mm, more preferably 286 to 310 mm, in the direction of fiber orientation when the distance between adjacent second regions is longer than that between adjacent first regions in the second patterning member, the second regions extend over a direct distance of 206 mm or more, preferably 206 to 300 mm, more preferably 206 to 225 mm, in the direction perpendicular to the direction in which the first regions extend when the distance between adjacent first regions is longer than that between adjacent second regions in the second patterning member.

[6] The method according to any one of [3] to [5], wherein the second patterning member has a plurality of perforations each having a circular shape with a diameter of 0.5 to 5 mm, preferably 1.0 to 4.0 mm, the perforations formed in the first region have an area ratio of 10% to 90%, preferably 15% to 70%, relative to the area of the first region, the second patterning member has a thickness of 0.1 to 10 mm, preferably 0.5 to 6 mm, more preferably 1 to 3 mm, and the first region and the second region independently have a width of 1 to 10 mm, preferably 1.5 to 6 mm, more preferably 2 to 5 mm.

[7] The method according to any one of [1] to [6], The method according to any one of claims 1 to 4, wherein the support of the first patterning member comprises a plurality of second wire-like members extending in a direction different from the direction in which the first wire-like members extend and arranged at a predetermined interval.

[8] The method according to [7], wherein at least one of the first wire-like member and the second wire-like member has a nearly triangular cross-section and is disposed with its triangular cross-section pointing up or down.

[9] The method according to [8], wherein the first wire-like member has a nearly triangular cross-section and is disposed with its triangular cross-section pointing down, and the second wire-like member has a nearly triangular cross-section and is disposed with its triangular cross-section pointing up.

[10] The method according to [8], wherein the first wire-like member has a nearly triangular cross-section and is disposed with its triangular cross-section pointing up, and the second wire-like member has a nearly triangular cross-section and is disposed with its triangular cross-section pointing up.

[11] The method according to [8], wherein the first wire-like member has a nearly triangular cross-section and is disposed with its triangular cross-section pointing down, and the second wire-like member has a nearly triangular cross-section and is disposed with its triangular cross-section pointing down.

[12] The method according to any one of [8] to [11], wherein the first patterning member has the first wire-like members or the second wire-like members arranged at a varying interval.

[13] The method according to any one of [8] to [11], wherein the first patterning member has a portion in which the first wire-like members align at a gradually decreasing or increasing interval in the direction of alignment, or the second wire-like members align at a gradually decreasing or increasing interval in the direction of alignment.

[14] The method according to any one of [7] to [13], wherein the cross-sectional triangles of the second wire-like members have a pitch Rp of 2 to 30 mm, preferably 4 to 20 mm, more preferably 6 to 18 mm, a base length $W_2$ of 0.4 to 7 mm, preferably 0.5 to 5 mm, and a height H2 of 1.0 to 10 mm, preferably 1.5 to 7 mm.

[15] The method according to any one of [1] to [14], wherein the space S between adjacent first wire-like members is 0.025 to 15 mm, preferably 0.1 to 10 mm, more preferably 0.5 to 8 mm, and the cross-sectional triangle of the first wire-like member has a base length $W_1$ of 0.4 to 7 mm, preferably 0.5 to 5 mm, and a height $H_1$ of 1.0 to 10 mm, preferably 1.5 to 7 mm.

[16] The method according to any one of [1] to [15], wherein the open area ratio OA of 5% to 90%, more preferably 10% to 85%, the open area ratio OA being calculated from formula: $OA\ (\%)=S/(S+W_1)\times 100$, where $W_1$ is the base length of the triangle of the first wire-like member; and S is the space between adjacent first wire-like members.

[17] A bulky sheet formed by entangling fibers of a fiber web with themselves and having a first side and a second side opposite to the first side, the bulky sheet having a plurality of macroscopic first recessed ridges and a plurality of macroscopic projections on at least the first side, the plurality of first recessed ridges extending straight in a first direction at an interval of 0.825 to 15 mm, the first direction being coincident with the orientation direction of the fibers, and the projection being located between the first recessed ridges adjacent to each other and projecting from the second side toward the first side of the bulky sheet.

[18] The bulky sheet according to [17], wherein the fibers of the fiber web are entangled with themselves and with a scrim.

[19] A bulky sheet formed by entangling fibers of a fiber web with themselves and with a scrim and having a first side and a second side opposite to the first side, the bulky sheet having a plurality of macroscopic first recessed ridges and a projection on at least the first side, the plurality of first recessed ridges extending straight in a first direction at an interval of 0.825 to 15 mm, the first direction being coincident with the orientation direction of the fibers, the projection being located between the first recessed ridges adjacent to each other and projecting from the second side toward the first side of the bulky sheet, the bulky sheet having a first region and a second region in a plan view, the first region having a higher fiber density and a smaller thickness than the second region, the second region having a lower fiber density and a larger thickness than the first region, the second region being delineated by the first region, the first region having a first portion extending in the orientation direction of the fibers and a second portion extending in the direction perpendicular to the direction in which the first portion extends, the second portion measuring 286 mm or more in direct distance in the orientation direction of the fibers when the distance between second portions adjacent to each other is longer than that between first portions adjacent to each other, and the second portion measuring 206 mm or more in the direction perpendicular to the direction in which the first portion extends when the distance between first portions adjacent to each other is longer than that between second portions adjacent to each other.

[20] The bulky sheet according to [19], wherein the second portion measures 286 mm or more, preferably 286 to 400 mm, more preferably 286 to 310 mm, in direct distance in the orientation direction of the fibers when the distance between adjacent second portions is longer than that between adjacent first portions, the second portion measures 206 mm or more, preferably 206 to 300 mm, more preferably 206 to 225 mm, in direct distance in the direction perpendicular to the direction in which the first portion extends when the distance between adjacent first portions is longer than that between adjacent second portions.

[21] The bulky sheet according to [19] or [20], wherein the first region has a fiber density of 0.020 to 0.65 g/cm$^3$, preferably 0.035 to 0.50 g/cm$^3$, and the second region has a fiber density of 0.005 to 0.65 g/cm$^3$, preferably 0.01 to 0.40 g/cm$^3$, provided that the fiber density of the second region is lower than that of the first region.

[22] The bulky sheet according to any one of [19] to [21], wherein the first region has a thickness of 0.1 to 1.5 mm, and the second region has a thickness of 1.0 to 5.0 mm, preferably 1.2 to 4.0 mm.

[23] The bulky sheet according to any one of [19] to [22], wherein the first region 71 has an area ratio of 2% to 90%, preferably 5% to 40%, and the second region 72 has an area ratio of 10% to 98%, preferably 60% to 95%.

[24] The bulky sheet according to any one of [19] to [23], wherein the first region has a plurality of small projections having a circular shape with a diameter of 0.5 to 5.0 mm, preferably 1.0 to 4.0 mm, and the small projections are formed to an area ratio of 10% to 90%, preferably 15% to 70%, relative to the area of the first region in a plan view.

[25] The bulky sheet according to any one of [18] to [24], wherein the scrim has a strand diameter of 50 to 600 μm, a spacing of 2 to 30 mm between strands, and an air permeability of 0.1 to 1000 cm$^3$/(cm$^2$·sec).

[26] The bulky sheet according to any one of [17] to [25], further having a second recessed ridge extending straight in a second direction substantially perpendicular to the first direction, the projection having in a plan view a nearly rectangular shape defined by the intersection of the first and the second recessed ridges.

[27] The bulky sheet according to [26], The bulky sheet according to claim 14, wherein the first recessed ridge is deeper than the second recessed ridge in a cross-section across the thickness of the bulky sheet.

[28] The bulky sheet according to [26] or [27], wherein the projection has an area of 0.5 to 300 mm$^2$, preferably 6 to 155 mm$^2$, in a plan view.

[29] The bulky sheet according to any one of [17] to [28], wherein the plurality of first recessed ridges are arranged at an interval of 0.825 to 15 mm, preferably 1.3 to 10.8 mm, more preferably 2.02 to 9.52 mm.

[30] The bulky sheet according to any one of [17] to [29], having an entanglement coefficient of 0.05 to 2 N·m/g, preferably from 0.2 to 1.5 N·m/g.

[31] The bulky sheet according to any one of [17] to [30], wherein the projection has a width Wp of 0.5 to 15 mm, preferably 2 to 5 mm, the first recessed ridge has a width Wg of 0.5 to 8 mm, preferably 1 to 4 mm, the first recessed ridge has a depth D of 0.5 to 6 mm, preferably 1 to 4 mm, the interval P of the first recessed ridges is 0.825 to 15 mm, preferably 1.3 to 10.8 mm, more preferably 2.02 to 9.52 mm, and the apparent thickness T of the bulky sheet is 1.0 to 7 mm, preferably 1.1 to 5 mm.

[32] The bulky sheet according to any one of [17] to [31], wherein, the ratio of the area ratio of the first recessed ridges to the area ratio of the projections, each relative to the apparent area of the bulky sheet in a plan view is 1:0.5 to 1:5, preferably 1:1.5 to 1:3.

[33] The bulky sheet according to any one of [17] to [32], having an apparent density of 0.002 to 0.100 g/cm$^3$, preferably 0.005 to 0.060 g/cm$^3$, and a basis weight of 25 to 110 g/m$^2$, preferably 30 to 80 g/m$^2$.

[34] The bulky sheet according to any one of [17] to [33], wherein the fibers have a thickness of 0.8 to 30 dtex, preferably 0.8 to 7 dtex and a length of 20 to 100 mm, preferably 30 to 65 mm.

[35] The bulky sheet according to any one of [17] to [34], having a KES compression stiffness LC of 0.08 to 0.30(–) and a KES compression work WC of 0.21 to 1.50 (gf·cm/cm$^2$).

[36] The bulky sheet according to any one of [17] to [35], containing fibers having a fineness of less than 1.45 dtex and a length of more than 38 mm in a ratio of 10% to 50% by mass based on the total mass of the bulky sheet.

[37] The bulky sheet according to [36], containing fibers having a fineness of 5.0 dtex or more and a length of 25 mm or more in a ratio of 1% to 50% by mass based on the total mass of the bulky sheet.

EXAMPLES

The invention will now be shown in greater detail with reference to Examples, but it should be understood that the invention is not deemed to be limited thereto.

The methods for determining and evaluating various physical properties of bulky sheets obtained in Examples and Comparative Examples are described below.

(1) Basis Weight

Ten specimens measuring 100 mm in width and 100 mm in length were cut out of a bulky sheet. Each specimen was weighed, and the weight was divided by the area to give the basis weight (g/m$^2$). An average value (n=10) was taken as the basis weight of the bulky sheet.

(2) Apparent Thickness T

Determined in accordance with the method described supra.

(3) Apparent Density

Determined in accordance with the method described supra.

(4) Hair Trapping Ratio

Ten human hairs having a length of 10 cm were scattered over a 1 m by 1 m area of a wooden floor. The area was wiped with a bulky sheet attached to a cleaning tool Quickle Wiper (from Kao Corp.), and the number of hairs caught on the sheet was counted. A hair trapping ratio was calculated as a ratio of the number of hairs caught up to the number of hairs scattered.

(5) Sesame Seed Trapping Ratio

Ten sesame seeds were scattered over a 1 m by 1 m area of a wooden floor. The area was wiped with a bulky sheet attached to Quickie Wiper (from Kao Corp.), and the number of sesame seeds caught on the sheet was counted. The sesame seed trapping ratio was obtained as a ratio of the number of seeds caught up to the number of seeds scattered.

(6) Bread Crumb Trapping Ratio

Bread crumbs (grain size: 1.0 to 1.4 mm) weighing 0.5 g were scattered over a 1 m by 1 m area of a wooden floor. The area was wiped with a bulky sheet attached to Quickie Wiper (from Kao Corp.), and the mass of the bread crumbs caught on the sheet was measured. The bread crumb trapping ratio was obtained as a ratio of the mass of the bread crumbs caught up to the mass of the scattered bread crumbs.

Example 1

A bulky sheet was made using the apparatus 100 shown in FIG. 4. Fiber webs having a basis weight of 24 g/m$^2$ were prepared by carding polyester fibers (1.45 dtex×38 mm) in a usual manner. A stack of a polypropylene lattice net (spacing between strands: 8 mm; strand diameter: 300 μm) as a scrim and the fiber web on each side of the scrim was subjected to hydroentanglement by directing jets of water from a plurality of nozzles under a water pressure of 1 to 10 MPa to form an entangled fiber web 41. The resulting entangled fiber web 41 was further subjected to water jets from a plurality of nozzles under a water pressure of 1 to 10 MPa using a patterning member described in Table 1 below thereby to accomplish three-dimensional patterning, followed by hot air drying to give a bulky sheet. The patterning member was set such that the direction in which the first wire-like members 141 extend was coincident with the transport direction of the entangled fiber web 41. There was thus obtained a bulky sheet of the type shown in FIGS. 1 and 2.

Examples 2 to 7

A bulky sheet was made in the same manner as in Example 1, except for using the patterning member shown in Table 1. The bulky sheets obtained in Examples 2 to 6 were of the type shown in FIGS. 1 and 2. The bulky sheet of Example 6 contained no scrim. The bulky sheet obtained in Example 7 was of the type shown in FIG. 3. The second patterning member used in Example 7 was the structure shown in FIG. 9 which was made of metal. The second patterning member had the following geometry: the width of the first region 95*a* and the second region 95*b* was 4.2 mm; the perforations 94*b* had a circular shape with a diameter of 2 mm; the pitch of the perforations was 3.2 mm; the length $L_2$ (see FIG. 9) of the first region 95*a* extending between adjacent second regions 95*b* was 287 mm; and the distance $W_4$ (see FIG. 9) between adjacent first regions 95*a* was 21 mm.

Comparative Example 1

A bulky sheet was obtained in the same manner as in Example 1, except for using the patterning member shown in FIGS. 5(*a*) to 5(*c*) of JP 2001-336052A.

TABLE 1

| | Example | | | | | | | Compa. |
|---|---|---|---|---|---|---|---|---|
| | 1 | 2 | 3 | 4 | 5 | 6 | 7 | Example 1 |
| First Patterning Member | | | | | | | | |
| Cross-section of Patterning Member 131 | 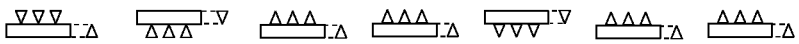 | | | | | | | — |
| Triangle Base Length $W_1$ of Wire-like Member 141 (mm) | 1.52 | 1.52 | 1.52 | 1.52 | 1.52 | 1.52 | 1.52 | — |
| Triangle Height $H_1$ of Wire-like Member 141 (mm) | 2.54 | 2.54 | 2.54 | 2 | 2.54 | 2 | 2 | — |
| Space S between Adjacent Triangles of Wire-like Member 141 (mm) | 4 | 4 | 3 | 2 | 3 | 4 | 3 | — |
| Triangle Base Length $W_2$ of Wire-like Member 142 (mm) | 1.52 | 1.52 | 1.52 | 1.52 | 1.52 | 1.52 | 1.52 | — |
| Triangle Height $H_2$ of Wire-like Member 142 (mm) | 2.54 | 2.54 | 2.54 | 2.54 | 2.54 | 2.54 | 2.54 | — |
| Pitch Rp of Triangles of Wire-like Member 142 (mm) | 14 | 14 | 14 | 12 | 14 | 12 | 12 | — |
| Second Patterning Member | no | no | no | no | no | no | yes (FIG. 9) | no |
| Scrim | yes | yes | yes | yes | yes | no | yes | yes |
| Bulky Sheet | | | | | | | | |
| Basis Weight (g/m$^2$) | 52.7 | 52.4 | 50.6 | 50.9 | 52.5 | 52.5 | 51.2 | 53.2 |
| Apparent Thickness T (mm) | 3.12 | 2.80 | 2.60 | 1.41 | 2.53 | 1.17 | 2.04 | 1.23 |
| Apparent Density (g/cm$^3$) | 0.017 | 0.019 | 0.019 | 0.036 | 0.021 | 0.045 | 0.025 | 0.043 |
| Hair Trapping Ratio (%) | 85 | 65 | 70 | 60 | 75 | 55 | 55 | 50 |
| Sesame Seed Trapping Ratio (%) | 45 | 40 | 45 | 40 | 50 | 50 | 50 | 15 |
| Bread Crumb Trapping Ratio (%) | 42 | 45 | 46 | 33 | 40 | 30 | 31 | 27 |

As is apparent from the results in Table 1, for use as a cleaning sheet the bulky sheet obtained in each Example is able to successfully trap both fine dust, such as hairs, and relatively large dust, such as sesame seeds and bread crumbs. In contrast, the bulky sheet of Comparative Example 1 exhibits hair trapping ability but is inferior in trapping capabilities for relatively large dust, such as sesame seeds and bread crumbs, when used as a cleaning sheet.

The invention claimed is:

1. A method for making a bulky sheet comprising directing high pressure water jets to a fiber web to entangle the fibers of the fiber web with themselves to form an entangled fiber web, placing the entangled fiber web on a first patterning member having apertures in a predetermined pattern, and subjecting the entangled fiber web placed on the first patterning member to high pressure water jets to cause part of the entangled fiber web to project into the apertures of the first patterning member, the first patterning member comprising a plurality of first wiry members extending in one direction and arranged at a predetermined spacing and a support having a plurality of openings, and the support underlying the plurality of first wiry members, wherein the support of the first patterning member comprises a plurality of second wiry members extending in a direction different from the direction in which the first wiry members extend and arranged at a predetermined interval, at least one of the first wiry member and the second wiry member has a nearly triangular cross-section and is disposed with its triangular cross-section pointing up or down, and the first wiry member has a nearly triangular cross-section and is disposed with its triangular cross-section pointing down, and the second wiry member has a nearly triangular cross-section and is disposed with its triangular cross-section pointing up.

2. The method according to claim 1, wherein the fibers of the fiber web are entangled with a scrim by the high pressure water jets to form the entangled fiber web.

3. The method according to claim 1, wherein a three-dimensional patterning member having the first patterning member and a second patterning member disposed on the first patterning member is used, and the high pressure water jets are directed to the entangled fiber web placed on the three-dimensional patterning member, the second patterning member has a plurality of first regions extending in an orientation direction of the fibers and a plurality of second regions extending in the direction perpendicular to the direction in which the first region extends, the first regions adjacent to each other are interconnected via the second region arranged in between or interconnected to form a junction, thereby to provide the second patterning member with a plurality of openings, each first region extends over a direct distance of 286 mm or longer in the fiber orientation direction when the distance between the second regions adjacent to each other is longer than that between the first regions adjacent to each other, or each second region extends over a direct distance of 206 mm or more in the direction perpendicular to the direction in which the first regions extend when the distance between the first regions adjacent to each other is longer than that between second regions adjacent each other, the portion of the entangled fiber web that is located on the second patterning member forms a first region, and the portion of the entangled fiber web that is located on the opening of the second patterning member is three-dimensionally shaped in conformity to a recess exposed in the opening to form a second region delineated by the first region.

4. The method according to claim 3, wherein the fiber web has a continuous form and is transported in one direction to form the bulky sheet of continuous form, and the continuous form bulky sheet is cut at least crosswise to obtain a cut bulky sheet, the cutting is at a selected position such that the second region in the cut bulky sheet is not completely surrounded by the first regions.

5. The method according to claim 1, wherein the first patterning member has the first wiry members or the second wiry members arranged at a varying interval.

6. The method according to claim 1, wherein the first patterning member has a portion in which the first wiry members align at a gradually decreasing or increasing interval in the direction of alignment, or the second wiry members align at a gradually decreasing or increasing interval in the direction of alignment.

* * * * *